US010017929B2

(12) United States Patent
Shinohara et al.

(10) Patent No.: US 10,017,929 B2
(45) Date of Patent: Jul. 10, 2018

(54) DISCHARGE VALVE APPARATUS, FLUSH WATER TANK APPARATUS, AND FLUSH TOILET

(71) Applicant: TOTO LTD.

(72) Inventors: Koki Shinohara, Kitakyushu (JP); Hideki Tanimoto, Kitakyushu (JP); Mayu Okubo, Kitakyushu (JP); Yoshitaka Tsuru, Kitakyushu (JP); Makoto Abe, Kitakyushu (JP); Yukinori Kubozono, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 131 days.

(21) Appl. No.: 15/067,653

(22) Filed: Mar. 11, 2016

(65) Prior Publication Data

US 2016/0273202 A1 Sep. 22, 2016

(30) Foreign Application Priority Data

Mar. 17, 2015 (JP) ..... 2015-053429
Mar. 17, 2015 (JP) ..... 2015-053430
Mar. 18, 2015 (JP) ..... 2015-054760

(51) Int. Cl.
*E03D 1/34* (2006.01)
*E03D 1/14* (2006.01)
*E03D 1/33* (2006.01)

(52) U.S. Cl.
CPC ..... *E03D 1/34* (2013.01); *E03D 1/144* (2013.01); *E03D 1/33* (2013.01)

(58) Field of Classification Search
CPC ..... E03D 1/33; E03D 1/34
USPC ..... 4/378
See application file for complete search history.

(56) References Cited

U.S. PATENT DOCUMENTS 317,055 A * 5/1885 Weeden ..... E03D 1/34 4/388
2012/0255111 A1* 10/2012 Kido ..... E03D 1/142 4/378
2013/0180039 A1* 7/2013 Kido ..... E03D 1/35 4/378
2013/0254982 A1* 10/2013 Yamasaki ..... E03D 1/36 4/378
2015/0082529 A1* 3/2015 Shinohara ..... E03D 1/142 4/378

FOREIGN PATENT DOCUMENTS

JP 2013-104271 A 5/2013

* cited by examiner

*Primary Examiner* — Huyen Le
(74) *Attorney, Agent, or Firm* — Studebaker & Brackett PC

(57) ABSTRACT

A discharge valve apparatus includes a discharge main body, disposed above a flush water tank discharge port, for opening and closing the flush water tank discharge port by the up and down motion of a valve body disposed inside a casing; wherein the discharge main body includes an attachment portion allowing an operating wire extending from a wire pull-up operating apparatus to detachably attach to a valve body portion.

10 Claims, 27 Drawing Sheets

DISCHARGE VALVE APPARATUS, FLUSH WATER TANK APPARATUS, AND FLUSH TOILET

BACKGROUND OF THE INVENTION

1. Technical Field

The present invention relates to a discharge valve apparatus, a flush water tank apparatus including this discharge valve apparatus, and a flush toilet including this flush water tank apparatus; in particular, it relates to a discharge valve apparatus attached to a discharge port on a flush water tank for storing flush water used to flush a toilet, a flush water tank including this discharge valve apparatus, and a flush toilet including this flush water tank apparatus.

2. Description of Related Art

As shown in Patent Document 1 (Japanese Patent Unexamined Publication No. 2013-104271), what are known as direct drive discharge valve apparatuses have been known for some time, in which an operating member extending from a manual operating apparatus is attached to a primary shaft member of a valve body disposed inside a discharge valve apparatus casing, and the valve body and valve body primary shaft member are pulled up from a valve port through a lifting action by the operating member moving in tandem with the manual operation.

In such discharge valve apparatuses, an operating member extending from a manual operating device is attached to the primary shaft member of a valve body inside a casing when manufactured at a factory or the like, and the exterior casing of the discharge valve apparatus is assembled so as not to be easily removable and disassembled.

BRIEF SUMMARY OF THE INVENTION

For discharge valve apparatuses to which a manual operating device is already attached, however, there has been a need to retrofit discharge valve apparatuses for automation by further adding an automatic wire pull-up type of operating apparatus.

In this case, the problem arises that because the discharge valve apparatus exterior casing cannot be easily removed and disassembled at the discharge valve apparatus installation site, a step is required to first transport it to a factory or the like to attach an automatic wire pull up operating apparatus.

It was thus difficult to conveniently and accurately attach an operating wire extending from a retrofitted automatic operating apparatus to a valve body or the like inside a casing.

Another problem was that in conventional discharge valve apparatuses, because the operating apparatus, mounted separately from the discharge valve apparatus, and the discharge valve apparatus itself were not configured to be easily detachable on site, failures of the discharge valve apparatus occurred required replacement of the operating apparatus together with the discharge valve apparatus.

Therefore the present invention was undertaken to solve problems and issues with the conventional art, and has the object of providing a discharge valve apparatus including an attachment portion capable of conveniently and accurately connecting an operating wire extending from a wire pull-up operating apparatus to a valve body inside the casing of a discharge valve apparatus.

To achieve the aforementioned object, the present invention is a discharge valve apparatus attached to a discharge port on a flush water tank comprising: a discharge main body disposed above the flush water tank discharge port, the discharge main body having a valve body portion disposed inside a casing; wherein the discharge main body includes an attachment portion, the attachment portion allowing an operating wire extending from a wire pull-up operating apparatus to detachably attach to the valve body portion.

In the invention thus constituted, the discharge main body attachment portion can removably attach an operating wire extending from a wire pull-up operating apparatus to a valve body portion disposed inside a discharge main body casing.

Therefore if one adds a wire pull-up operating apparatus and later wishes to attach it to a discharge valve apparatus, for example, the operating wire can be conveniently and accurately attached to a valve body portion disposed inside a discharge main body casing.

Also, when removing a discharge valve apparatus from a wire pull-up operating apparatus for repair or replacement, for example, the same operating apparatus operating wire can be conveniently and accurately attached to a valve body portion disposed inside the casing of the same or a different discharge valve apparatus discharge main body after removing the operating wire from a valve body portion disposed inside a discharge main body casing, and removing the discharge valve apparatus from the operating apparatus for repair or replacement.

Therefore an operating wire extending from a wire pull-up operating apparatus can be conveniently and accurately connected to a valve body portion inside a discharge valve apparatus casing.

In the present invention, preferably, the attachment portion includes a valve body-side attachment hole portion disposed at the top portion of the valve body portion shaft and the valve body-side attachment portion having an attachment hole; and a casing-side attachment hole portion having a casing attachment hole disposed on the upper portion of the casing.

According to the invention thus constituted, the operating wire end portion is inserted from the outside through the casing attachment hole and into the valve body-side attachment hole, and is attached to a valve body-side hole portion disposed on the upper portion of the valve body portion shaft. Therefore the discharge main body attachment portion can removably attach an operating wire extending from a wire pull-up operating apparatus to a valve body-side attachment hole portion disposed on the upper portion of a valve body portion disposed inside a discharge main body casing. Hence an operating wire extending from a wire pull-up operating apparatus can be conveniently and accurately connected to a valve body portion inside a discharge valve apparatus casing.

In the present invention, preferably, the attachment portion includes a tube attachment portion capable of detachably attaching a tube covering the operating wire to the casing.

According to the invention thus constituted, the tube attachment portion of the attachment portion can removably attach a tube covering an operating wire to the casing on a discharge main body. Therefore a tube covering an operating wire extending from a wire pull-up operating apparatus can be conveniently and accurately connected to a valve body portion inside a discharge valve apparatus casing.

In the present invention, preferably, the tube attachment portion of the attachment portion includes a projection for preventing the attached tube from detaching from the casing.

According to the invention thus constituted, a projecting portion on the tube attachment portion of the attachment portion can prevent the attached tube from detaching the casing. Therefore a tube covering an operating wire extending from a wire pull-up operating apparatus can be conveniently and reliably connected to a valve body portion inside a discharge valve apparatus casing.

In the present invention, preferably, the tube attachment portion of the attachment portion includes a tube pull-out stop member for preventing the attached tube from detaching from the casing.

According to the invention thus constituted, the tube pull-out stop member can prevent the attached tube from detaching from the casing. Therefore a tube covering the operating wire extending from a wire pull-up operating apparatus can be conveniently and reliably connected to a valve body portion inside a discharge valve apparatus casing.

In the present invention, preferably, the casing attachment hole on the casing-side attachment hole portion of the attachment portion and the valve body-side attachment hole of the valve body-side attachment hole portion disposed on the upper portion of the valve body portion shaft are disposed on an essentially straight line when the valve body portion is raised at a predetermined position.

According to the invention thus constituted, the casing attachment hole on the casing-side attachment hole portion of the attachment portion and the valve body-side attachment hole of the valve body-side attachment hole portion disposed on the upper portion of the valve body portion shaft reach an essentially straight line alignment position when the valve body portion is at a predetermined raised position. Therefore the end portion of the operating wire can be inserted from the outside through a casing attachment hole in a straight line manner into the valve body-side attachment hole. Hence the discharge main body attachment portion can removably attach an operating wire extending from a wire pull-up operating apparatus to a valve body portion disposed inside a discharge main body casing.

In the present invention, preferably, the tube includes a flange portion whose outside diameter is at least in part larger than the outside diameter of the tube at the end portion of the tube; and wherein the tube attachment portion of the attachment portion includes a narrow width-shaped narrow width channel portion extending inward from the side surface of the casing peak portion wherein the narrow width-shaped narrow width channel portion has a top portion that has an opening at the casing peak surface, and extends inward from the side surface of the casing peak portion such that the narrow width-shaped narrow width channel portion holds the tube part extending upward from the flange portion; and a wide width channel portion connected to the bottom portion of the narrow width channel portion, wherein the wide width channel portion extends inward from the side surface of the casing peak portion, and has a width that is wider than a width of the narrow width channel portion such that the wide width channel portion holds the flange portion, the flange portion being inserted into the wide width channel portion from the side of the casing.

According to the invention thus constituted, the flange portion in which the outside diameter of the tube is at least in part expanded more than the tube part can be inserted and attached into the wide width channel portion inwardly from the side surface of the casing peak portion, and the tube part extending from the flange portion can be inserted and attached into the narrow width channel portion inwardly from the side surface of the casing peak portion. Hence the tube in which the tube attachment portion covers the operating wire can be removably attached to the discharge main body casing. Therefore a tube covering an operating wire extending from a wire pull-up operating apparatus can be conveniently and accurately connected to a valve body portion inside a discharge valve apparatus casing.

In the invention, preferably, the casing-side attachment hole portion on the attachment portion includes a casing-side slit portion extending upward from the valve body-side attachment hole in the valve body-side attachment hole portion, and extending up to a position at which the inner operating wire is attached; and the valve body-side attachment hole portion of the attachment portion includes a valve body-side slit extending upward from the valve body attachment hole in the valve body-side attachment hole portion, and extending up to a position at which the inner operating wire is attached.

According to the invention thus constituted, after the end portion of the operating wire is inserted through the casing attachment hole into the valve body-side attachment hole, the operating wire can move from the casing attachment hole through the inside of the casing-side slit portion to the operating wire attachment position, and the operating wire can move from the valve body-side attachment hole through the valve body portion-side slit portion to the operating wire attachment position.

Therefore after the operating wire end portion has been inserted from the outside into the valve body-side attachment hole through the casing attachment hole, the operating wire can be moved to change the orientation from one above the casing attachment hole and valve body-side attachment hole to one above the attachment position, so that it can be placed in an attachment position at which the operating wire can lift up the valve body-side attachment hole portion disposed on the valve body portion.

Also, the present invention is a flush water tank apparatus comprising a discharge valve apparatus.

The invention thus constituted can provide a flush water tank apparatus in which an operating wire extending from a wire pull-up type of operating apparatus can be conveniently and accurately connected to a valve body portion inside a discharge valve apparatus casing.

Also, the present invention is a flush toilet comprising a flush water tank apparatus.

The invention thus constituted can provide a flush toilet comprising a flush water tank apparatus in which an operating wire extending from a wire pull-up type of operating apparatus can be conveniently and accurately connected to a valve body portion inside a discharge valve apparatus casing.

Using a discharge valve apparatus, a flush water tank apparatus comprising this discharge valve apparatus, and a flush toilet comprising this flush water tank, an operating wire extending from a wire pull-up type of operating apparatus can be conveniently and accurately connected to a valve body inside a discharge valve apparatus casing.

DETAILED DESCRIPTION OF THE INVENTION

Below, referring to the attached figures, we explain a discharge valve apparatus, a flush water tank including this discharge valve apparatus, and a flush toilet including this flush water tank apparatus according to a first embodiment of the invention.

Figure 1:
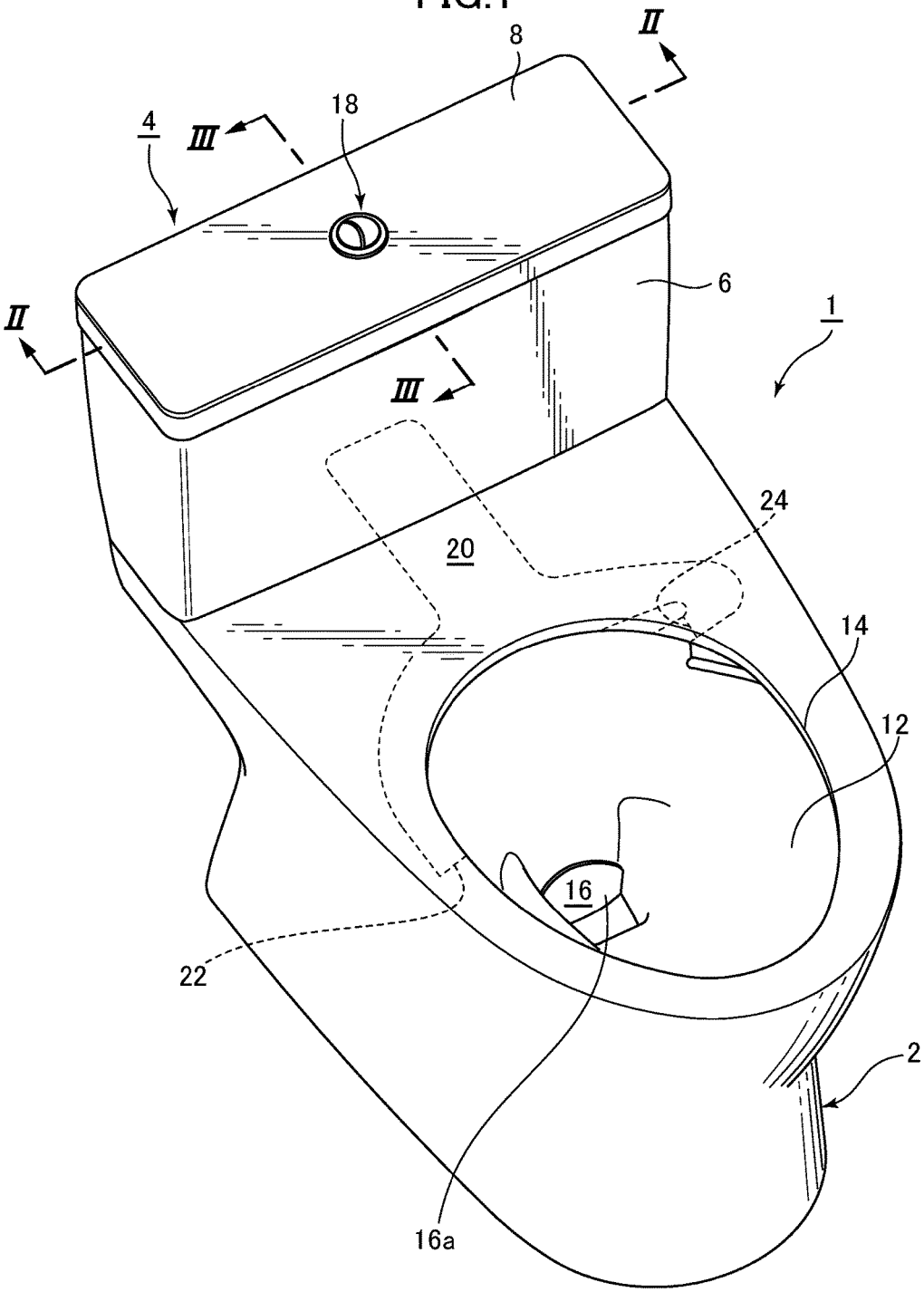
FIG. 1: A summary perspective view of a flush toilet in which a discharge valve apparatus according to a first embodiment of the invention is applied.
Figure 2:
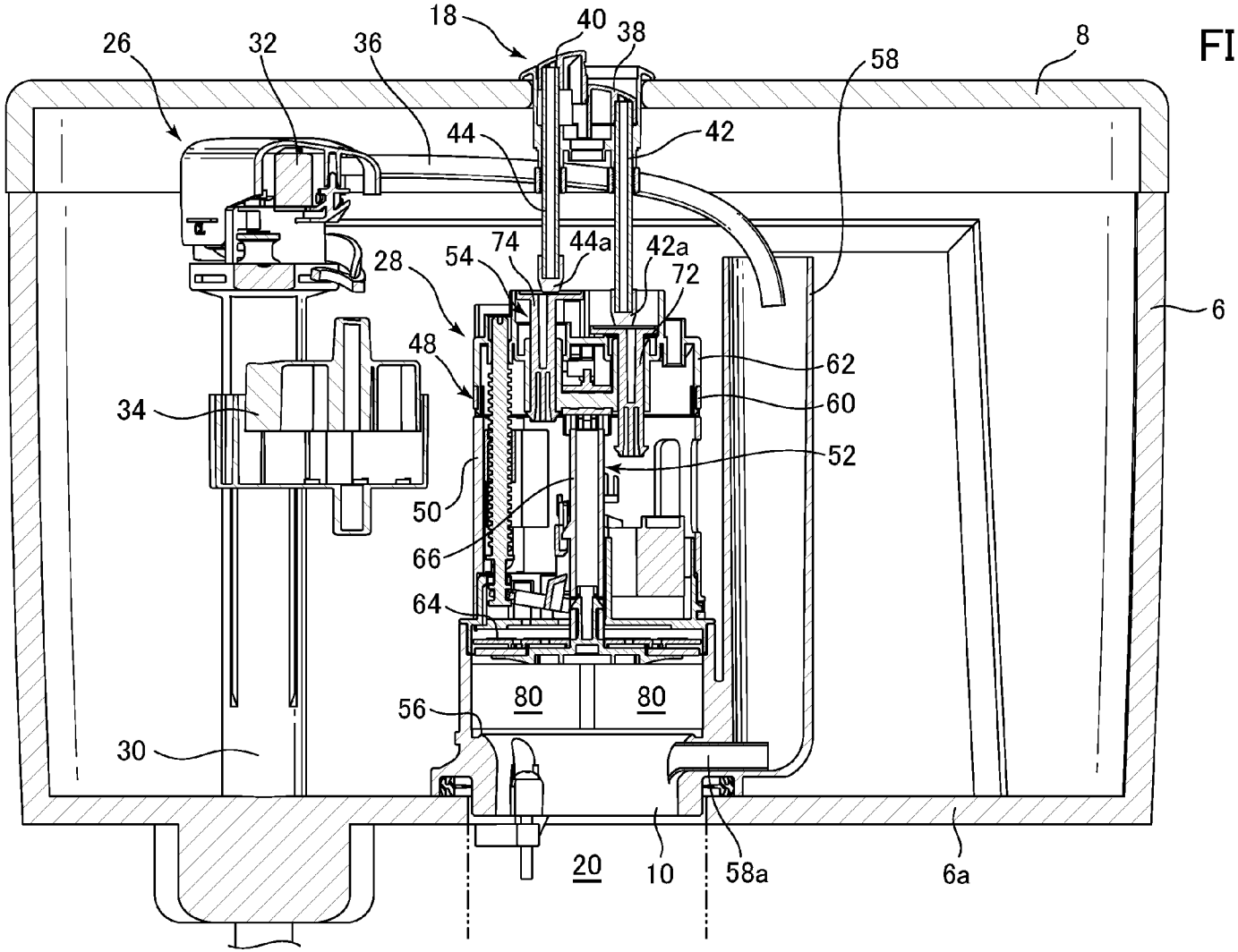
FIG. 2: A cross section along line II-II in FIG. 1.
Figure 3:
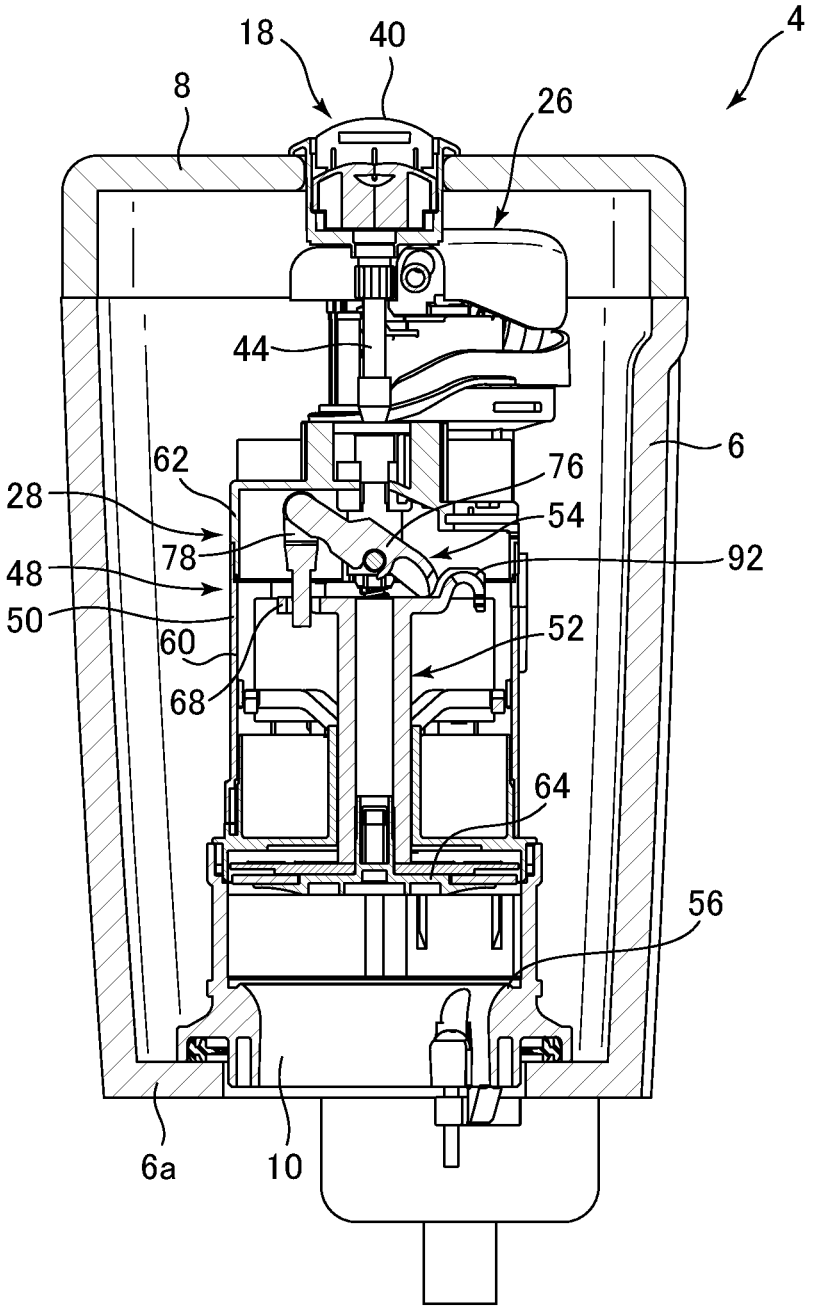
FIG. 3: A cross section along line III-III in FIG. 1.

First, referring to FIGS. 1 through 3, we explain a flush toilet to which a discharge valve apparatus according to a first embodiment of the invention is applied.

FIG. 1 is a summary perspective view of a flush toilet to which a discharge valve apparatus according to a first embodiment of the invention is applied; FIG. 2 is a cross section seen along line II-II in FIG. 1; FIG. 3 is a cross section seen along line III-III in FIG. 1.

As shown in FIG. 1, a flush toilet apparatus 1 including a flush toilet to which a discharge valve apparatus according to a first embodiment of the invention is applied includes a toilet main body 2 for receiving waste, and a cuboid flush water tank apparatus 4 disposed above and to the rear of this toilet main body 2.

The flush water tank apparatus 4 includes a reservoir tank 6 for storing flush water for flushing a toilet. Also, a drain opening 10 penetrating in the vertical direction is provided at the bottom portion 6*a* of this reservoir tank 6.

Note that the first embodiment of the invention may also be a flush toilet in which the flush water tank apparatus 4 and the toilet main body 2 are separately formed, or may be what is known as a one piece flush toilet, in which the flush water tank apparatus 4 and the toilet main body 2 are formed as a single piece.

At the peak portion of this flush water tank apparatus 4, a lid 8 affixed so as to be freely removable from the top edge of the reservoir tank 6 is disposed to cover the entirety of the opening part of the top of the reservoir tank 6.

A pushbutton type of manual operating apparatus 18, discussed below in detail, is disposed on the top surface of the lid 8. When a user pushes the manual operating apparatus 18 pushbutton down, a predetermined flow volume of flush water is supplied from the flush water tank apparatus 4 to the toilet main body 2 according to flush type: large flush mode flush operation or small flush mode flush operation.

The flush toilet apparatus 1 toilet main body 2 includes a bowl portion 12 disposed on the front side thereof, and a rim portion 14 formed on the top edge of the bowl portion 12.

A discharge trap conduit 16 entry 16*a* is opened on the bottom portion of the bowl portion 12 in the flush toilet 2 and connected from this entry 16*a* to an underfloor discharge pipe (not shown) through a discharge socket (not shown) in the discharge trap conduit 16 in the rear.

A flush toilet 1 according to the present embodiment may be of the type known as a siphon flush toilet, in which a siphon action is used to suction waste in the bowl portion 12 and discharge it all at once from the discharge trap conduit 16, but the flush toilet 1 is not limited to a siphon type flush toilet, and the invention may also be applied to other types of flush toilets, such as those known as wash-down flush toilets, in which waste is pushed out by the action of water flow resulting from a water drop in the bowl portion.

Next, the flush toilet 2 includes: a water conduit 20 into which flush water discharged from the discharge port 10 on the reservoir tank 6, a first rim spout opening 22 formed near the left center of the rim portion 14 as seen from the front, and a second rim spout opening 24 (see FIG. 1) formed at the right rear as seen from the front of the rim portion 14.

Furthermore, the water conduit 20 forms a flow path extending from the rear center of the flush toilet 2 toward the front side, then branching and extending to either the first rim spout opening 22 or the second rim spout opening 24. Flush water discharged from the reservoir tank 6 discharge port 10 flows in the water conduit 20 from the rear center of the flush toilet 2 toward the front side, then is branched and reaches the first rim spout opening 22 or the second rim spout opening 24. Flush water respectively spouted from the first rim spout opening 22 and the second rim spout opening 24 flushes the bowl portion 12 and discharges waste from the discharge trap conduit 16.

Next, referring to FIGS. 2 and 3, we explain the internal structure of a flush water tank in a flush toilet to which the discharge valve apparatus according to the first embodiment of the invention has been applied.

As shown in FIGS. 2 and 3, the toilet main body portion 4 includes: a water supply apparatus 26 for supplying flush water into the reservoir tank 6; a manual operation apparatus 18 which by a user's hand, etc. starts either a large flush mode flush operation or a small flush mode flush operation; and a discharge valve apparatus 28 for opening a discharge port 10 to flush water stored in a reservoir tank 6 and allowing it to flow into the water conduit 20 on the flush toilet 2.

The water supply apparatus 26 includes: a water supply pipe 30, connected to an external water supply source (not shown) and disposed to extend upward from the bottom portion of the reservoir tank 6; a water supply valve 32, attached to the top end portion of this water supply pipe 30, for switching between spouting and stopping water into the interior of the reservoir tank 6 for flush water supplied from the water supply pipe 30; and a float 34 for moving up and down in response to fluctuations in the water level in reservoir tank 6 to switch between spouting and stopping water.

Multiple water spout ports (not shown) are formed on the outer perimeter-side bottom end portion of the water supply pipe 30, and flush water which has passed through the water supply valve 32 is spouted into the reservoir tank 6 from a spout port (not shown).

In the water supply apparatus 26, when flush water in the reservoir tank 6 is discharged into the toilet, the water level of the flush water drops and the float 34 falls, causing the water supply valve 32 to open and start spouting from the spout port; spouting from a water source (not shown) outside the reservoir tank 6 into the reservoir tank 6 is then started. In addition, when water spouting is continued and the water level in the reservoir tank 6 rises, the float 34 rises, resulting in closing of the water supply valve 32, thereby stopping water from being spouted from the spout port. By this means the flush water level inside reservoir tank 6 is maintained at a predetermined full water level.

Note that water supply apparatus 26, although not discussed in the present embodiment, includes a refill 36; part of the flush water flowing out from this refill 36 flows into an overflow pipe and can be supplied into the bowl portion 12 as replenishment water through the water conduit 20 in the flush toilet 2.

The manual operation apparatus 18 is a pushbutton manual operation apparatus. The manual operation apparatus 18 includes a large flush button 38 for mechanically directing the start of a large flush mode flush operation in the flush toilet 1; a small flush water button 40 for mechanically directing the start of a small flush mode flush operation in the flush toilet 1; a large flush rod member 42 affixed to the bottom side of the large flush button 38 and extending downward; and a small flush rod member 44 affixed to the bottom side of the small flush water button 40 and extending downward.

As shown in FIG. 2, when a user pushes a large flush button 38, the large flush rod member 42 is pushed down together with the large flush button 38, and the tip portion 42*a* of the large flush rod member 42 pushes down the large flush operation portion of the discharge valve apparatus, described below.

When a user pushes the small flush water button 40, the small flush rod member 44 is pushed down together with the small flush water button 40, and the tip portion 44*a* of the small flush rod member 44 pushes down the small flush operation portion of the discharge valve apparatus, described below.

When a user performs an operation to push this large flush button 38 or small flush water button 40, the discharge valve apparatus 28 can be driven in response to either a large flush mode flush operation or a small flush mode flush operation.

Note that in the first embodiment of the invention we explained the manual operation apparatus 18 by an example in which a valve raising operation can be accomplished by a manual operation of the large flush button 38 or the small flush water button 40, but the manual operation apparatus 18 may be formed as a mechanism in which a wire wind-up operating apparatus is operated by manually rotating an operating handle on an operating handle apparatus, enabling a valve body pull-up operation by pulling up the operating wire.

First we will explain the basic structure of a discharge valve apparatus 28 according to a first embodiment of the invention.

The discharge valve apparatus 28 has a discharge main body 48 disposed above the discharge port 10 on the reservoir tank 6.

The discharge main body 48 includes a casing 50 forming the external appearance of the discharge main body 48; a valve body portion 52 for opening and closing the discharge port 10 on the reservoir tank 6 by up and down motion inside the casing 50; a pull-up mechanism 54 capable of pulling the valve body portion 52 by operation from the outside of this casing 50; and a valve seat 56 formed in an approximately ring shape on the top portion of this discharge port 10, and projecting upward.

On the side of the casing 50, the discharge main body 48 may further include an overflow pipe 58 extending in the up-down direction.

The casing 50 is formed in a cylindrical shape, and is formed to cover the valve body portion 52 housed inside the casing 50 from the side and top.

Therefore it is formed so that users cannot easily access the valve body portion 52 and pull-up mechanism 54, etc. housed in the casing 50.

The discharge main body 48 casing 50 includes a cylindrical trunk portion 60 forming side surfaces of the casing 50, and a round lid portion 62 formed to generally cover the opening part in the peak portion of this trunk portion 60.

The lid portion 62 is relatively firmly affixed to the trunk portion 60 by locking with a tab or the like. I.e., after the lid portion 62 is temporarily attached to the trunk portion 60, a user cannot easily remove it at an installation site or the like; rather a specialist at a specialized factory removes the lid portion 62 from the trunk portion 60 and disassembles the casing. Note that in the casing 50, the trunk portion 60 and the lid portion 62 may also be formed from the beginning as a single piece, rather than as separate pieces.

The valve body portion 52 includes: a valve body 64 for closing off the discharge port 10 by seating on (contacting) the valve seat 56 disposed on the discharge port 10 on reservoir tank 6; a columnar main shaft member 66 extending upward from the valve body 64; and a flat plate attachment portion 68 extending from the top portion of the main shaft member 66 essentially horizontally in the lateral direction. This valve body 64 is formed in a disk shape.

On the flat plate attachment portion 68, an attachment hole 70 is formed near the center of the predetermined width of a cuboid-shaped flat plate extending sideways from the main shaft member 66. In the attachment hole 70 an opening in which both the top and bottom sides at the center of a square opening form an opening widening out in a convex shape toward the outside.

The pull-up mechanism 54 includes: a large flush operating portion 72, disposed so that its top surface is exposed to the peak surface of the lid portion 62 on the casing 50, and able to slide in the up-down direction; a small flush operating portion 74, disposed so that its top surface is exposed to the peak surface of the lid portion 62, and able to slide in the up-down direction; a first rotation link 76, which rotates about a rotational axis, starting from a standby state, when the large flush operating portion 72 or the small flush operating portion 74 axis is pushed downward; a first rotation link 76 for rotating from a standby state about a rotational axis; and a second link 78, rotatably attached at its own top end to one end of the first rotation link 76, moving upward in response to the amount of rotation of the first rotation link 76.

The first rotation link 76 is rotated up to a relatively large rotation amount in response to the relatively large amount of movement with the pushing in of the large flush operating portion 72. The first rotation link 76 is rotated up to a relatively small rotation amount in response to the relatively small amount of movement with the pushing in of the small flush operating portion 74.

After insertion into the attachment hole 70 on the flat plate attachment portion 68, disposition of the bottom end portion of the second link 78 at a changed orientation causes locking with the bottom surface of the flat plate attachment portion 68 when the second link 78 rises, so that the entire flat plate attachment portion 68 and the valve body portion 52 can be pulled up.

Therefore in a standby state in which the large flush operating portion 72 and the small flush operating portion 74 are not pushed down, the first rotation link 76 is in a standby state; the bottom end portion of the second link 78, which is linked with the first rotation link 76, is not locked with the flat plate attachment portion 68, and the valve body portion 52 is closing off the discharge port 10.

Next, as shown in FIG. 3, in a case in which a user pushes down the large flush button 38 and the large flush operating portion 72 is pushed in to start a large flush mode flushing operation, the first rotation link 76 is rotated by a relatively large rotation amount, and the second link 78 is pulled upward by a relatively large motion amount. Therefore the bottom end portion of the second link 78 pulls up the flat plate attachment portion 68 to a relatively large movement amount; the valve body portion 52 opens the discharge port 10, starting a large flush mode flush operation.

Next, when a user pushes down the small flush water button 40, and the small flush operating portion 74 is pushed downward so that a small mode flush operation is started, a first rotation link 76 is rotated by a relatively small rotational amount, and a second link 78 is pulled up by a relatively small movement amount. Hence the bottom end portion of the second link 78 raises the flat plate attachment portion 68 up to a relatively small amount of movement; the valve body portion 52 opens the discharge port 10; and a small flush mode flush operation is started.

On the overflow pipe 58, the downstream end portion of the downward flow path 58*a* in this overflow pipe 58 links to the lower discharge port 10 on the valve seat 56.

The overflow pipe 58 is able to cause outflow to the discharge valve apparatus 28 when the flush water inside the reservoir tank 6 exceeds the water level at a height corresponding to the top end position of the overflow pipe 58.

In addition, multiple communicating ports 80 are formed in the perimeter direction in a region above the valve seat 56 on the discharge main body 48, as shown in FIG. 2, and the opening cross section of each communicating port 80 is formed in a rectangle as viewed in front elevation.

Figure 6:
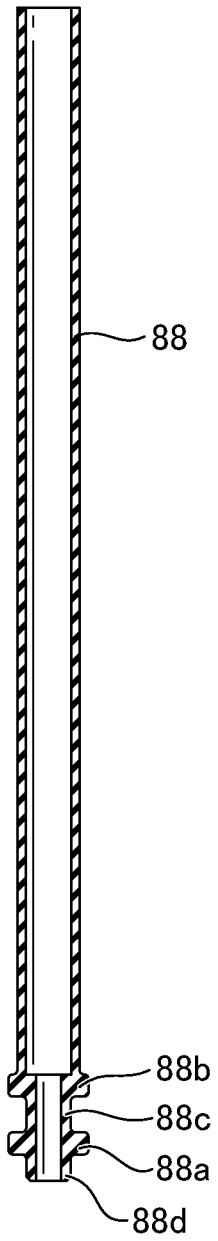
FIG. 6 is a cross section of a tube attached to the attachment hole portion of a discharge valve apparatus according to a first embodiment of the invention.

These communicating ports 80, as shown in FIG. 6, communicate between the interior of the reservoir tank 6 and the interior of the discharge main body 48, and can allow flush water in the reservoir tank 6 to flow into the discharge port 10.

Next, referring to FIGS. 4 through 11, we explain a structure enabling retrofitting of still another operating apparatus relative to discharge valve apparatus 28 of the first embodiment of the invention.

Figure 4:
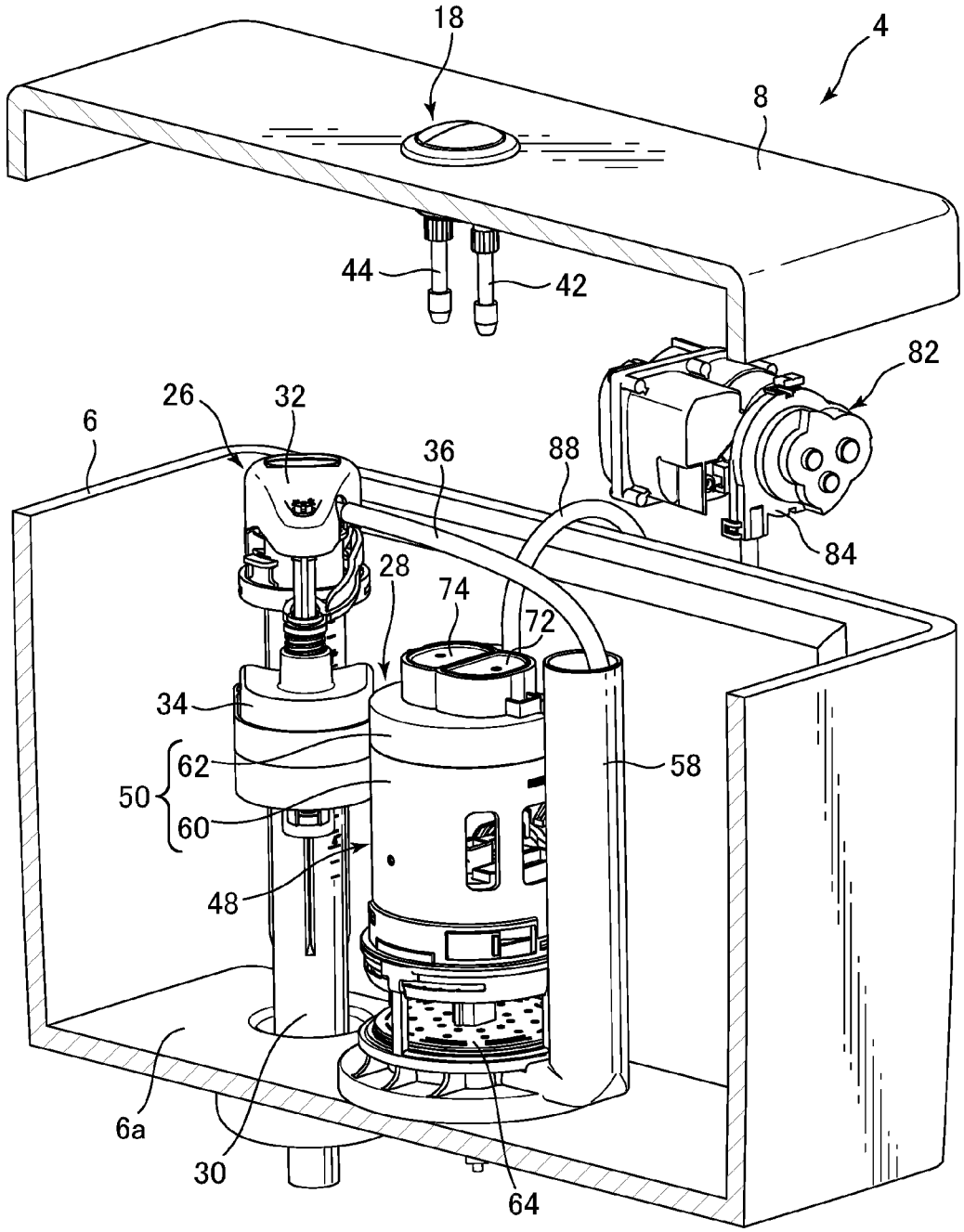
FIG. 4: A summary perspective view showing the state when a cover is lifted and an operating apparatus is retrofitted, in a flush water tank apparatus to which the discharge valve apparatus of a first embodiment of the invention is applied.
Figure 5:
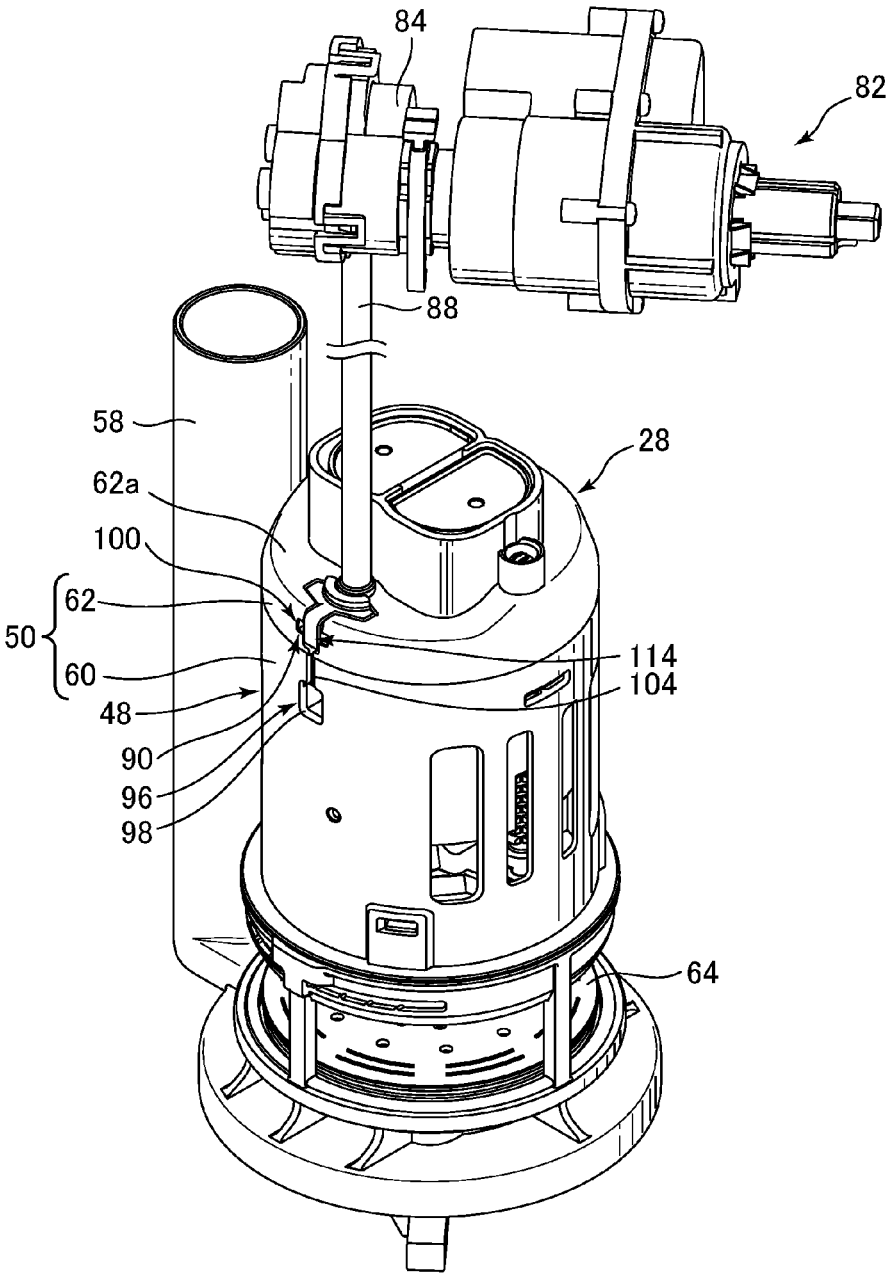
FIG. 5 is summary perspective view showing the appearance of a retrofit installation of an operating apparatus on a discharge valve apparatus according to a first embodiment of the invention.

FIG. 4 is a summary perspective view showing the state whereby in a flush water tank apparatus to which a discharge valve apparatus according to the first embodiment of the invention is applied, the lid portion is lifted up and the operating apparatus is retrofitted; FIG. 5 is a summary perspective view showing the appearance when an operating apparatus is retrofitted to a discharge valve apparatus according to a first embodiment of the invention; FIG. 6 is a cross section of a tube retrofitted to the attachment hole portion of a discharge valve apparatus according to a first embodiment of the invention.

Figure 7:
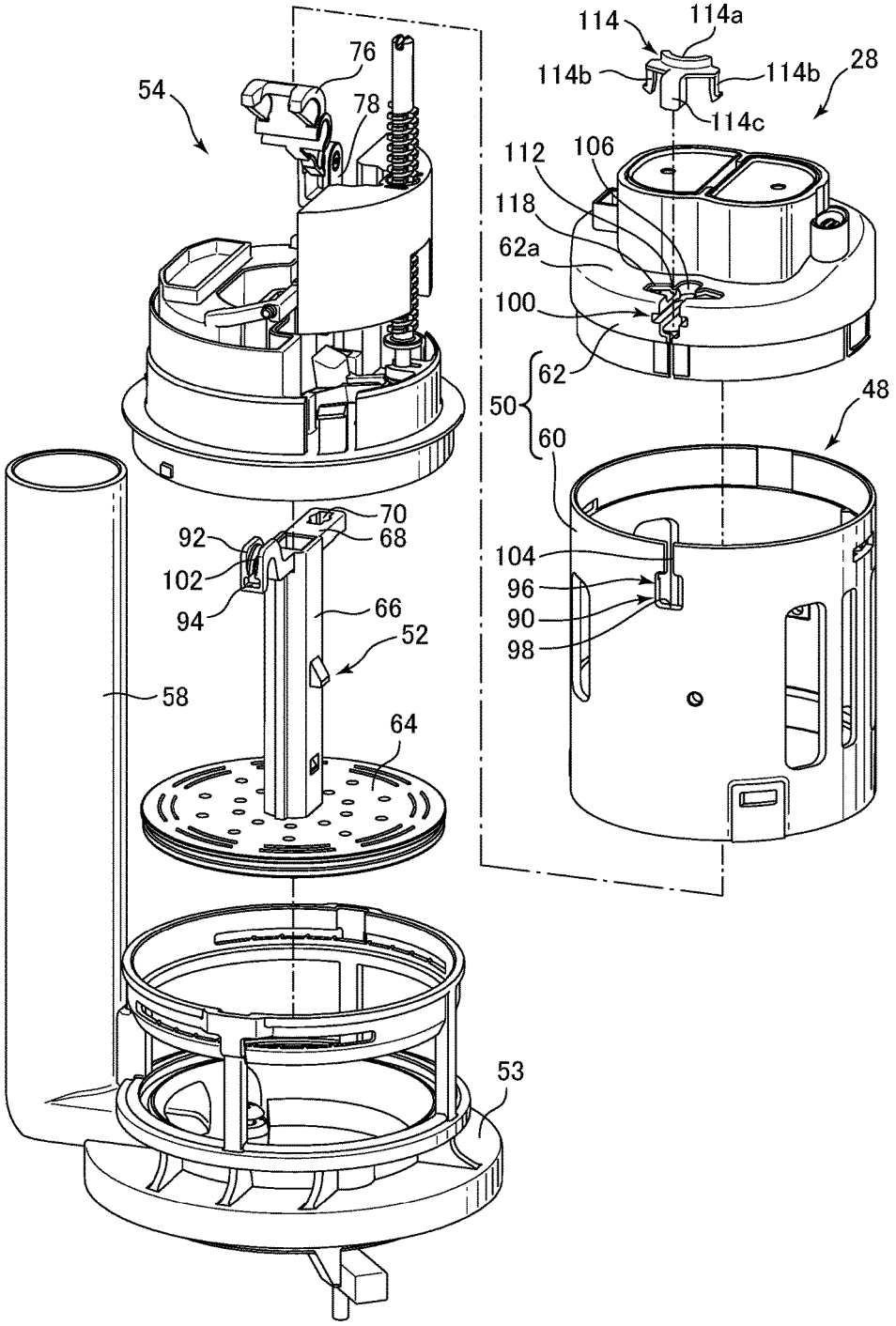
FIG. 7 is a partial perspective view of a discharge valve apparatus according to a first embodiment of the invention.
Figure 8:
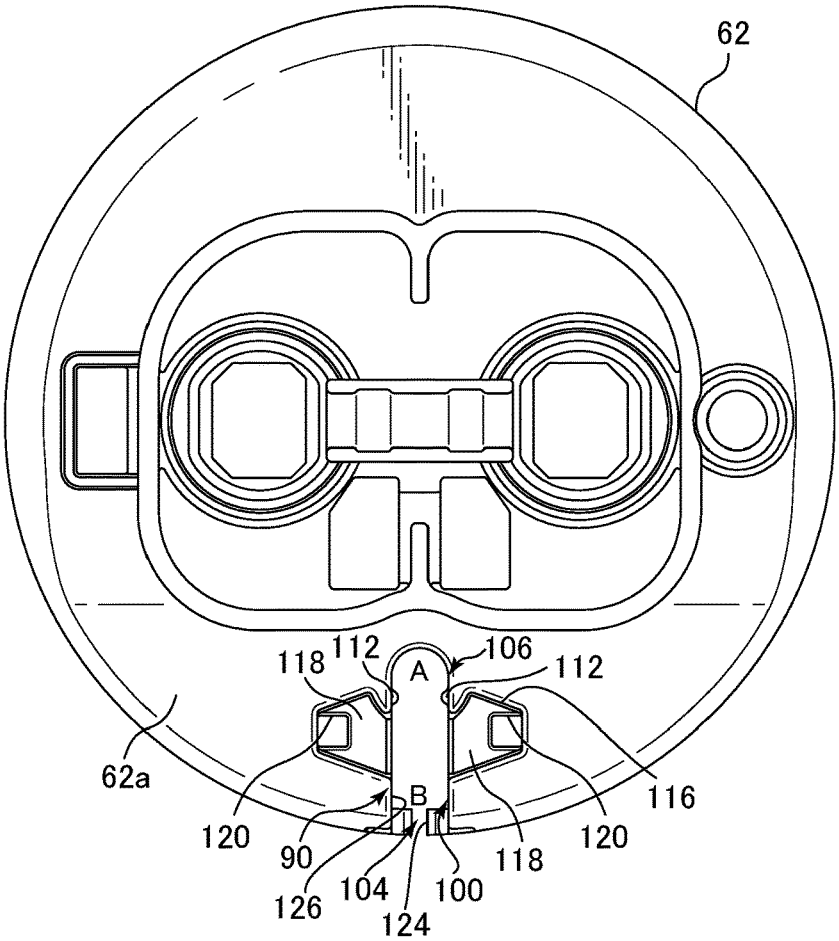
FIG. 8 is a plan view of the lid portion of a discharge valve apparatus according to a first embodiment of the invention.
Figure 9:
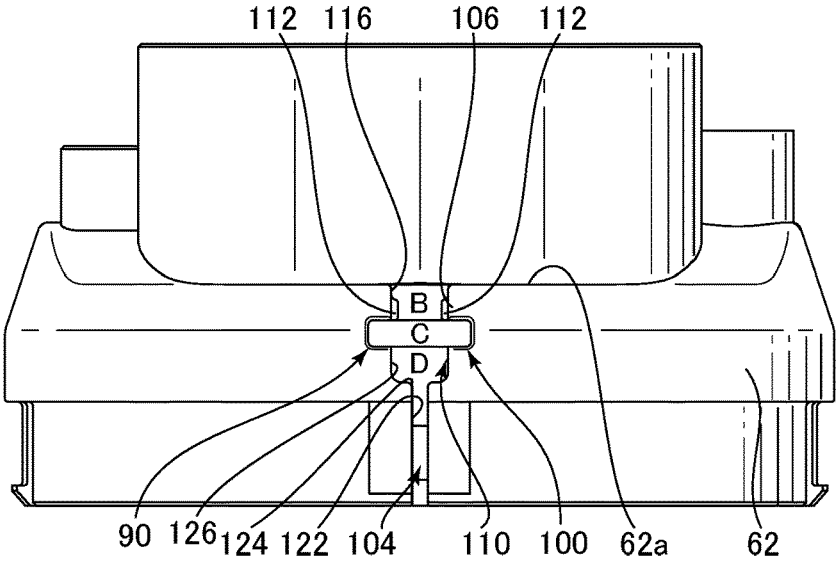
FIG. 9 is a side view of the lid portion of a discharge valve apparatus according to a first embodiment of the invention.

FIG. 7 is a partial perspective view of a discharge valve apparatus according to a first embodiment of the invention; FIG. 8 is a plan view of the lid portion of a discharge valve apparatus according to a first embodiment of the invention; FIG. 9 is a side elevation of the lid portion of a discharge valve apparatus according to a first embodiment of the invention.

Figure 10:
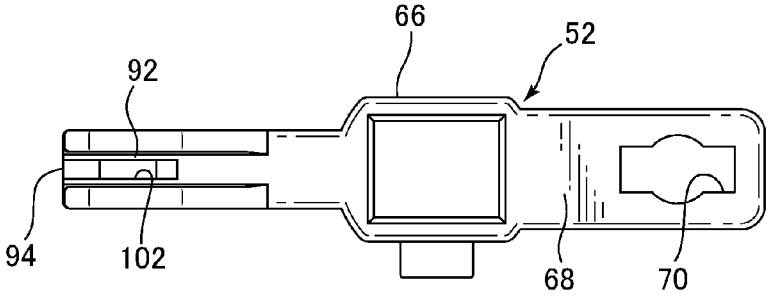
FIG. 10 is a plan view of the valve body portion of a discharge valve apparatus according to a first embodiment of the invention.
Figure 11:
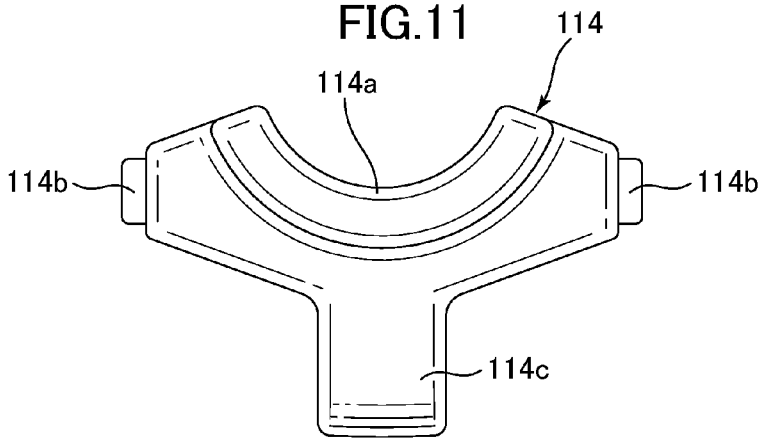
FIG. 11 is a plan view of a tube pull-out stop member in a discharge valve apparatus according to a first embodiment of the invention.

In addition, FIG. 10 is a perspective view of the valve body portion of a discharge valve apparatus according to a first embodiment of the invention, and FIG. 11 is a plan view of the tube pull-out stop member in a discharge valve apparatus according to a first embodiment of the invention. Note that in FIG. 5, the tube 88 and the operating wire 86 are attached at the attachment position A.

As shown in FIGS. 4 and 5, in addition to a pushbutton manual operating apparatus, still another wire pull-up operating apparatus 82 can be connected to the rear side of the discharge valve apparatus 28.

The wire pull-up operating apparatus 82 is a powered operating apparatus for automatic flushing which pulls up a wire with an electrically driven motor or the like based on a signal from a sensor or the like which senses the presence of a toilet user (or based on a control signal emitted from a controller receiving a signal from a sensor or the like).

Note that the wire pull-up operating apparatus 82 may be a manual operating apparatus in which operations such as user rotation of a lever or the like are converted to a wire pull-up action, or may be a powered operating apparatus other than one for automatic flushing, in which the wire pull-up is performed by an electrically driven motor based on signals from a wall-mounted remote control or the like (or based on a control signal emitted from a controller receiving a signal from a sensor or the like), or may be one which performs the wire pull-up action with by an integrated manual and powered system.

After the wire pull-up operating apparatus 82, which is a powered operating apparatus for automatic flushing, is installed into a flush water tank apparatus 4 of a discharge valve apparatus 28 already having a manual operating apparatus following assembly of the discharge valve apparatus 28 or after the discharge valve apparatus 28 has been used for a certain time period with the discharge valve apparatus 28 installed inside the flush water tank apparatus 4, the ability to retrofit provides an advantage in that a manual flush toilet including a manually operated flush water tank apparatus can be changed to an automatic flush toilet including a flush water tank apparatus for automatic flushing.

In addition, after a wire pull-up operating apparatus 82 is attached to the discharge valve apparatus 28, it is not necessary to take out both the discharge valve apparatus 28 and the operating apparatus 82 for repair and/or replacement, etc. if problems arise such as a discharge valve apparatus 28 failure, for example. I.e., the operating apparatus 82 can be easily removed from the discharge valve apparatus 28 on site, and only the discharge valve apparatus 28 repaired and/or replaced with a new discharge valve apparatus 28. The same is true when a failure or other problem arises with the operating apparatus 82; it is possible to repair and/or replace only the operating apparatus 82 with a new operating apparatus 82.

The wire pull-up operating apparatus 82 includes an operating apparatus main body 82 having a wire pull-up apparatus (not shown), an operating wire 86 attached at one end to a valve body portion 52 inside the operating apparatus main body 82 (see FIG. 14), and a tube 88, connected at one end to the operating apparatus main body 82 and attached at the other end to the casing 50 on the discharge valve apparatus 28.

The operating wire 86 is a metal member. The operating wire 86 is formed to have plasticity conformable to the bending of the tube 88 and the bending of spooling, while maintaining enough rigidity to maintain a certain degree of linearity when a certain length is held laterally. The operating wire 86 is formed so that its end portions 86*a* are formed to be thicker than the diameter of the wire part 86*b*, and to have a cuboid shape. The end portions 86*a* are cuboid in shape, and have an approximately rectangular (square) cross section parallel to the bottom surface.

The tube 88 is formed in a hollow shape of a plastic member such as rubber or the like. The operating wire 86 is able to slide within the tube 88.

As shown in FIG. 6, the tube 88 includes a first flange portion (pull-out stop portion) 88*a* and a second flange portion (pull-out stop portion) 88*b*, whereby at least a portion of the tube 88 outer diameter close to the end thereof connected to the discharge valve apparatus 28 is expanded. In the present embodiment, these flange portions are formed to project outward in a ring shape on the outside perimeter of the tube 88. These flange portions may also be formed in other shapes projecting outward on the outside perimeter.

The first flange portion 88*a*, by insertion into the wide width channel portion, being the wider of the lid portion 62 channel portions described below, prevents the tube 88 from pulling out in the vertical direction.

The wire pull-up operating apparatus 82 is disposed in a part difficult for users to see, outside the reservoir tank 6 and at the rear of the flush toilet 2. Note that the wire pull-up operating apparatus 82 can also be disposed inside the reservoir tank 6.

Next, in the discharge valve apparatus 28 according to a first embodiment of the invention we explain the structure shown in FIGS. 4 through 11, whereby in addition to a pushbutton manual operating apparatus, a wire pull-up apparatus 46 can be connected to the discharge valve apparatus 28.

As shown in FIGS. 5 and 6, the discharge main body 48 of the discharge valve apparatus 28 includes an attachment portion 90 allowing an operating wire 86 extending from the wire pull-up operating apparatus 82 to detachably attach to a valve body portion 52 disposed on the interior of the discharge main body 48 casing 50.

The attachment portion 90 of the discharge main body 48 includes: a valve body-side attachment hole portion 92 disposed on the top portion of the valve body portion 52 shaft and having a valve body-side attachment hole 94; a casing-side attachment hole portion 96 having a casing attachment hole 98 disposed on the top portion of the discharge main body 48 casing 50; a tube 88 covering the operating wire 86; and a tube attachment portion 100, removably attached to the discharge main body 48 casing 50.

As shown in FIGS. 3, 7, and 10, the valve body-side attachment hole portion 92 is formed in a hill-shaped curved hook shape, whereby it extends upward from a part extending essentially horizontally in the lateral direction from the top portion of the main shaft member 66, then extends very slightly in the horizontal direction, then extends downward. The valve body-side attachment hole portion 92 extends in the opposite direction to the flat plate attachment portion 68. The valve body-side attachment hole portion 92 has the same predetermined width as the flat plate attachment portion 68. The valve body-side attachment hole portion 92 has a valve body-side attachment hole 94, laterally open at the outer end portion of the hook-shaped part thereof. The valve body-side attachment hole 94 forms an essentially elongated opening portion.

The valve body-side attachment hole 94 is generally formed in a size such that the cuboid operating wire 86 end portions 86*a* can pass through it, and very slightly larger than the end portions. Therefore the operating wire 86 wire part 86*b* is also able to pass through the valve body-side attachment hole 94. Note that the valve body-side attachment hole 94 is formed to be of a size smaller than the casing attachment hole 98.

A valve body-side slit portion 102, described below, is connected to the center top of the valve body-side attachment hole 94, and an opening portion continues therefrom.

The casing-side attachment hole portion 96 includes the above-described casing attachment hole 98 and, as described below, a casing-side slit portion 104 formed to extend upward from the casing attachment hole 98 and to continue to the inner operating wire 86 attachment position A.

As shown in FIGS. 5 and 7, etc., the casing attachment hole 98 forms a rectangular through hole on the side surface of the top portion of the casing 50 trunk portion 60.

The casing attachment hole 98 is formed in a region which, on the perimeter of the trunk portion 60 side, includes a region extending in the outer perimeter-oriented opening direction of the valve body-side attachment hole 94, described below. The square casing attachment hole 98 is formed in a size such that the cuboid end portions 86*a* of the operating wire 86 can generally pass through it.

Therefore the wire part 86*b* of the operating wire 86 is also able to pass through the casing attachment hole 98. A casing-side slit portion 104, described below, connects to the center top of the casing attachment hole 98, and the opening continues upward.

As shown in FIG. 5, the tube attachment portion 100 is able to attach the tube 88 extending from the operating apparatus 82.

As shown in FIGS. 5 and 8, in the tube attachment portion 100, at the peak portion of the lid portion 62, the multiple channel portions of differing widths are respectively formed from the side portion up to a region extending essentially horizontally on the inside, and above the valve body-side attachment hole portion 92.

This tube attachment portion 100 includes a first width narrow channel portion 106, the top portion of which is open on the peak surface 62*a* of the lid portion 62, and which extends from the side surface of the lid portion 62 toward the inside upper attachment position A of the valve body-side attachment hole portion 92 so as to receive from the side the tube part 88*c* extending upward from the first flange portion 88*a*; a wide width channel portion 108, connected to the lower part of the first width narrow channel portion 106, and extending from the side surface of the lid portion 62 peak portion toward the inside upper attachment position A of the valve body-side attachment hole portion 92 and formed at a wider width than the first narrow width channel portion 106 so as to receive and hold the flange portion from the side of the casing 50 when the flange portion is inserted into the wide width channel portion 108; and a second narrow width channel portion 110, the bottom portion of which is opened to a space inside the casing 50, and extends toward the attachment position A over the inside valve body-side attachment hole portion 92 from the side of the lid portion 62 so as to receive from the side the tube part 88*d* extending downward from the first flange portion 88*a*. The attachment position A over the valve body-side attachment hole portion 92 refers to a predetermined attachment position at which the tube 88 is attached in order to perform lifting up of the valve body-side attachment hole portion 92 from above, using the operating wire 86.

Therefore the tube attachment portion 100, by insertion horizontally in a lateral orientation from the side of the lid portion 62, allows the tube part 88*c* extending upward from the first flange portion 88*a* to pass along the first narrow width channel portion 106, and the first flange portion 88*a* to pass along the wide width channel portion 108, and the tube part 88*d* extending downward from the first flange portion 88*a* to pass along the second narrow width channel portion 110, so that the tube 88 can be attached to the attachment position A above the valve body-side attachment hole portion 92.

As shown in FIGS. 8 and 9, the tube attachment portion 100 further includes a projecting portion 112 for preventing the attached tube part 88*c* from detaching from the casing 50.

As shown in FIGS. 5-9 and FIG. 11, the tube attachment portion 100 further includes: a tube pull-out stop member 114 for preventing the tube 88 from pulling out from the tube attachment portion 100; and a tube pull-out stop member attachment portion 116, which forms a depression 118 extending to the left and right in a wing shape from the middle region of the full length of the first narrow width channel portion 106, at a position outside the attachment position A of the first narrow width channel portion 106 on the peak surface of the lid portion 62, and at a position outside the projecting portion 112, in order to attach the tube pull-out stop member 114.

Next, as shown in FIG. 11, the tube pull-out stop member 114 is formed in approximately a T shape as seen in plan view.

The tube pull-out stop member 114 includes: a hold-down portion 114, formed in an arc shape toward the inside of the discharge valve apparatus 28 and holding down the outside of the second flange portion 88*b* of the tube so that it does not pull out in the outward direction; tab portions 114*b* extending downward from the T-shaped left and right ends; and a mating portion 114*c* extending from the T-shaped outside edge essentially perpendicularly downward. The mating portion 114*c* forms an approximately cuboid shape facing from up to down, the width of which in the left-right direction (perimeter direction) is formed to be very slightly less than the width of the first narrow width channel portion 106. In the region close to the side, the mating portion 114*c* engages the first narrow width channel portion 106, the wide width channel portion 108, and the second narrow width channel portion 110.

The tube pull-out stop member 114 is formed of an elastic member; locking between the tab portion 114*b* and the locking hole 120 is released by manual operation using a finger or the like, permitting removal from the tube pull-out stop member attachment portion 116.

The tube pull-out stop member attachment portion 116 furthermore forms a rectangular locking hole 120 close to its own left and right edges. The locking hole 120 is formed to be deeper than the surrounding depression 118, and is formed to penetrate the reverse surface of the lid portion 62. Therefore the tab portion 114*b* of the tube pull-out stop member 114 can be locked in place, inserted into the locking hole 120.

In this manner the tube pull-out stop member attachment portion 116 is formed by the region B from the middle region of the entire length of the depression 118, the locking hole 120, and the first narrow width channel portion 106 to the outer side surface, by the region C close to the side surface of the wide width channel portion 108, and by the region D close to the side surface of the second narrow width channel portion 110.

The tube pull-out stop member 114 is engaged with and locked to the tube pull-out stop member attachment portion 116. Locking of the tab portion 114*b* to the locking hole 120 on the tube pull-out stop member attachment portion 116 of the lid portion 62 prevents the tube pull-out stop member 114 from falling out of the tube pull-out stop member attachment portion 116. In an attached state, the cuboid mating portion 114*c* of the tube pull-out stop member 114 fits from the region B close to the side surface from the first narrow width channel portion 106 to the second narrow width channel portion 110, through the region C, to the region D.

In this manner, when the tube 88 tries to move from the tube attachment portion 100 sideways (in the outer direction), the tube pull-out stop member 114 engaged inside the tube pull-out stop member attachment portion 116 can stop the movement of the tube 88, and the tube 88 can be prevented from pulling out.

Next we explain the casing-side attachment hole portion 96 and the casing-side slit portion 104, as shown in FIGS. 7 through 9.

The casing-side attachment hole portion 96 further includes a casing-side slit portion 104 formed to extend upward from the casing attachment hole 98 and continue to the inner operating wire attachment position A.

The casing attachment hole 98 communicates with the casing-side slit portion 104.

The casing-side slit portion 104 includes: a side surface slit 122 which extends from the top center of the casing attachment hole 98 on the side surface of the trunk portion 60, as shown in FIG. 9, and forms a fine channel extending to the bottom end of the second narrow width channel portion 110 on the side surface of the lid portion 62; an internal first slit 124 which, as shown in FIGS. 8 and 9, forms a fine channel extending from a location on the outer perimeter surface to the inside at the bottom end of the second narrow width channel portion 110; and an internal second slit 126 opened to be relatively large so that from the inside end of the internal first slit 124 up to a region even further inside the attachment position A of the operating wire 86, the bottom end of the second narrow width channel portion 110 communicates with the interior space of the casing.

Details are discussed below, but when attaching the operating wire 86, a wire part 86*b* which has been passed through the casing attachment hole 98 can be raised on the side surface as it is passed through the side surface slit 122, can be raised toward the interior direction as it is passed through the internal first slit 124, and can be moved to attachment position A on the operating wire 86 as it is passed through the internal second slit 126.

The slit sizes of the side surface slit 122 and the internal first slit 124 are formed to be smaller than the size of the end portions 86*a*, allowing the end portions 86*a* of the operating wire 86 to pass through, and are conversely formed to be larger than the diameter of the wire part 86*b*, allowing the wire part 86*b* of the operating wire 86 to move freely.

Note that the slits may also be formed as holes, channels, openings, or gaps (the same is true below).

Next we explain the valve body-side slit portion 102 of the valve body-side attachment hole portion 92, as shown in FIGS. 7 through 10, etc.

The valve body-side attachment hole portion 92 further includes a valve body-side slit portion 102 on which, in the valve body-side attachment hole portion 92, a fine channel is formed to extend from the valve body-side attachment hole 94 upward, and to continue toward the inner main shaft member 66 up to the attachment position A on the operating wire 86.

This valve body-side slit portion 102 communicates with the valve body-side attachment hole 94. The valve body-side slit portion 102 is formed to extend to above the center of the valve body-side attachment hole 94, and as seen from the side is a slit formed so that it gradually rises to fit a hook shape, becoming horizontal at the hill-shaped peak portion. Seen in top plan view, the termination of the valve body-side slit portion 102 is positioned close to essentially the center part of the hook shaped part. Out of the valve body-side slit portion 102, the highest position in essentially the center part of the hook-shaped part at the operating wire 86 attachment position A.

Out of the valve body-side slit portion 102, the highest position in essentially the center part of the hook-shaped part at the operating wire 86 attachment position A.

On the inside of the valve body-side slit portion 102, the valve body-side attachment hole portion 92 sandwiches and holds the operating wire 86 through the wire part 86*b*, so the pull-up action of the end portions 86*a* on the operating wire 86 is transferred with relatively high precision to the valve body-side slit portion 102.

Next, referring to FIGS. 12 through 20, we explain the steps for retrofitting still another wire pull-up operating apparatus 82 to a discharge valve apparatus 28 according to a first embodiment of the invention.

Figure 12:
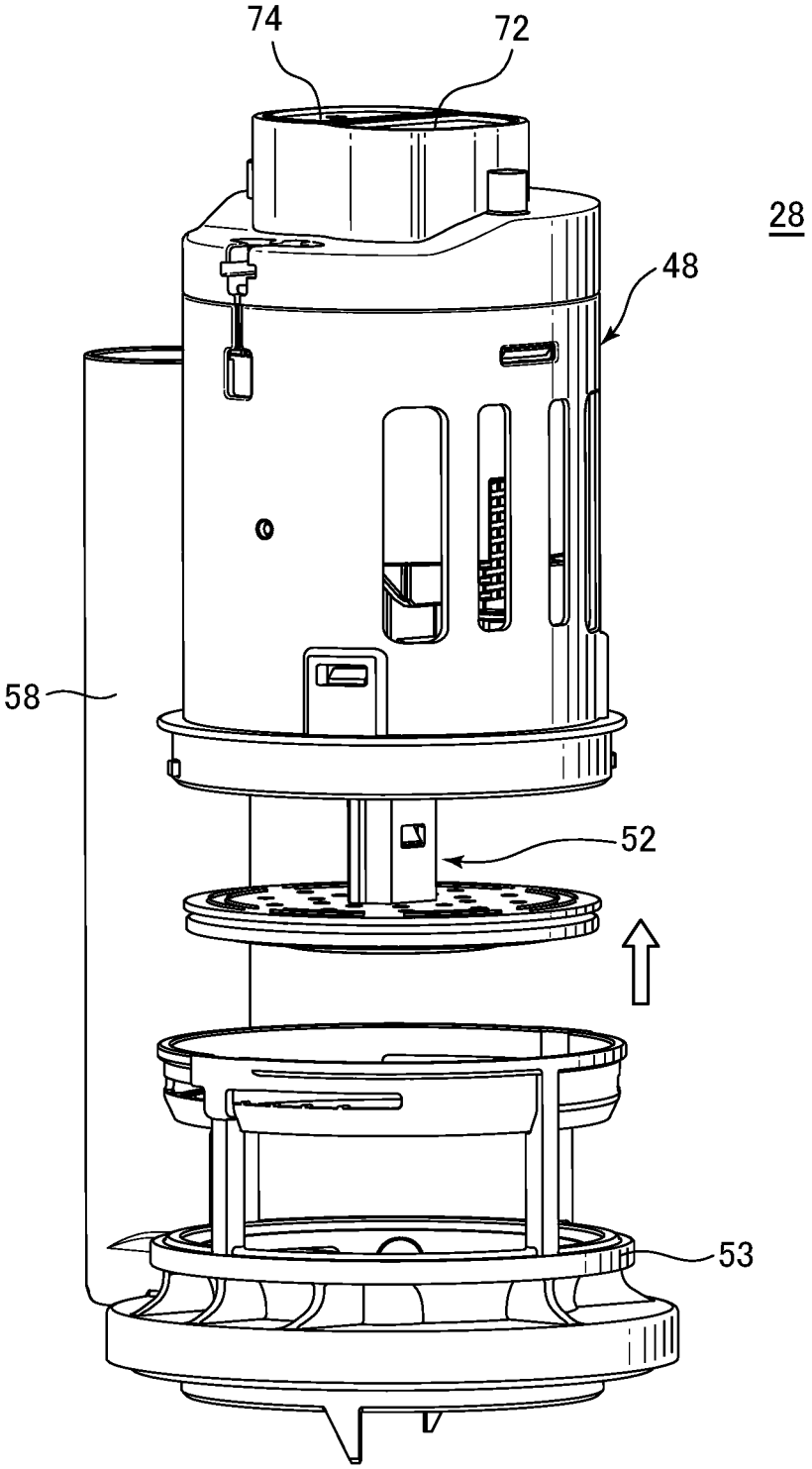
FIG. 12 is a diagram showing a step for disconnecting a discharge main body upward from a discharge port portion in a discharge valve apparatus according to a first embodiment of the invention.
Figure 13:
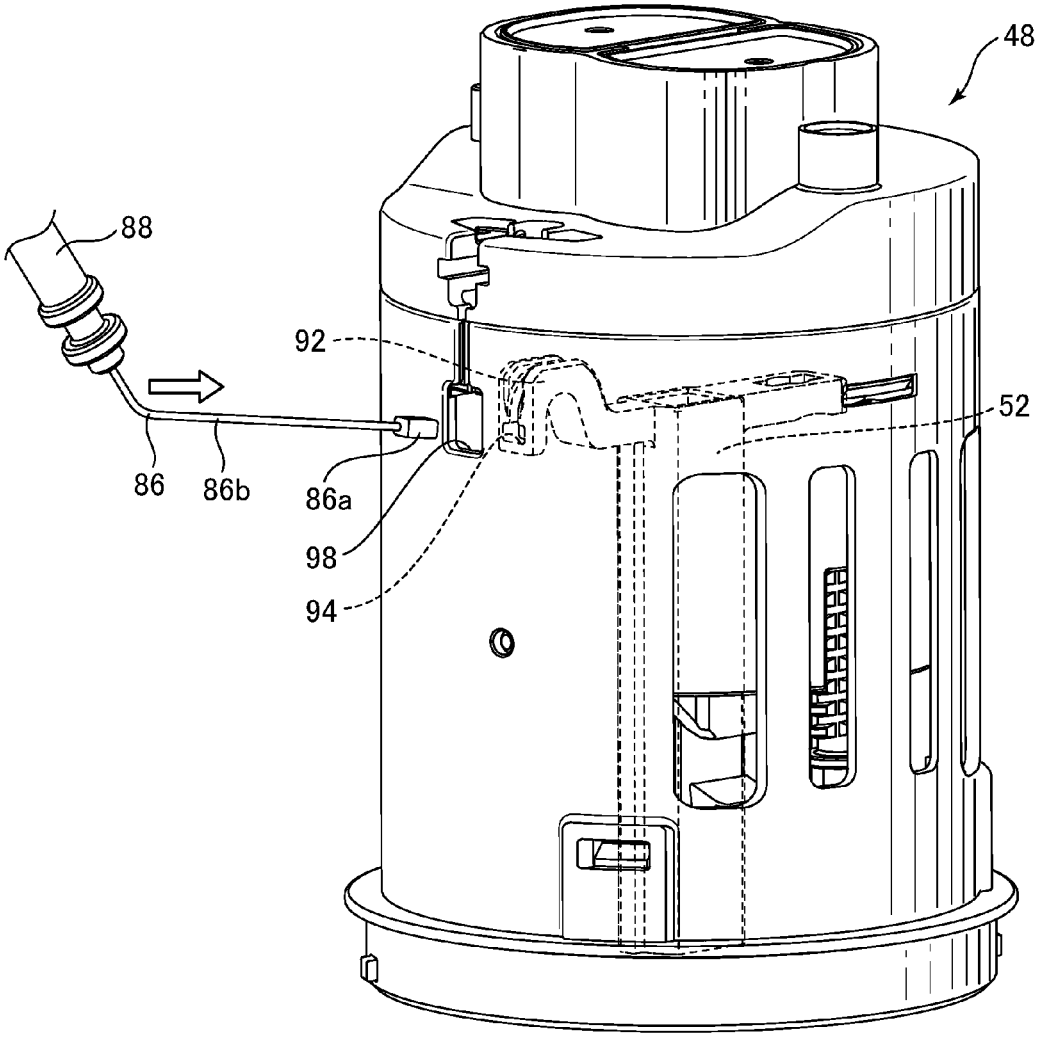
FIG. 13 is a diagram showing a step for inserting an operating wire from outside the discharge valve main body casing toward a casing attachment hole, with the valve body portion raised up to a position at which the valve body-side attachment hole and the casing attachment hole portion are aligned in essentially a straight line, in a discharge valve apparatus according to a first embodiment of the invention.
Figure 15:
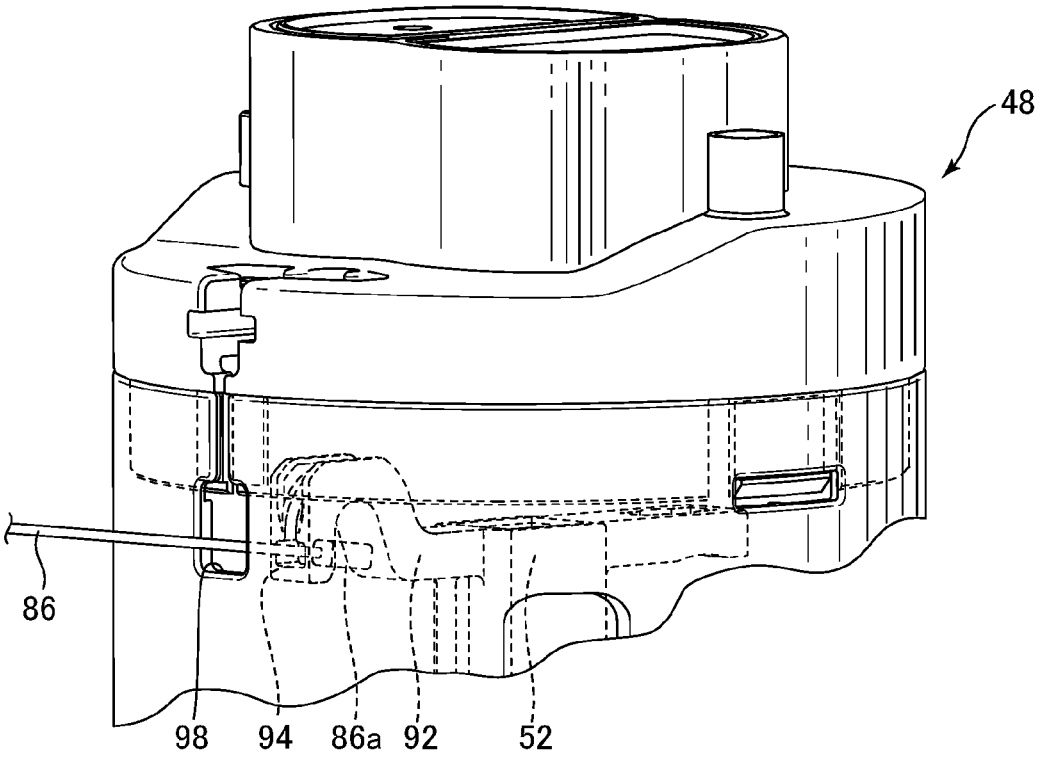
FIG. 15 is a diagram showing the operating wire end portion inserted laterally into the valve body-side attachment hole on the valve body portion, in a discharge valve apparatus according to a first embodiment of the invention.
Figure 16:
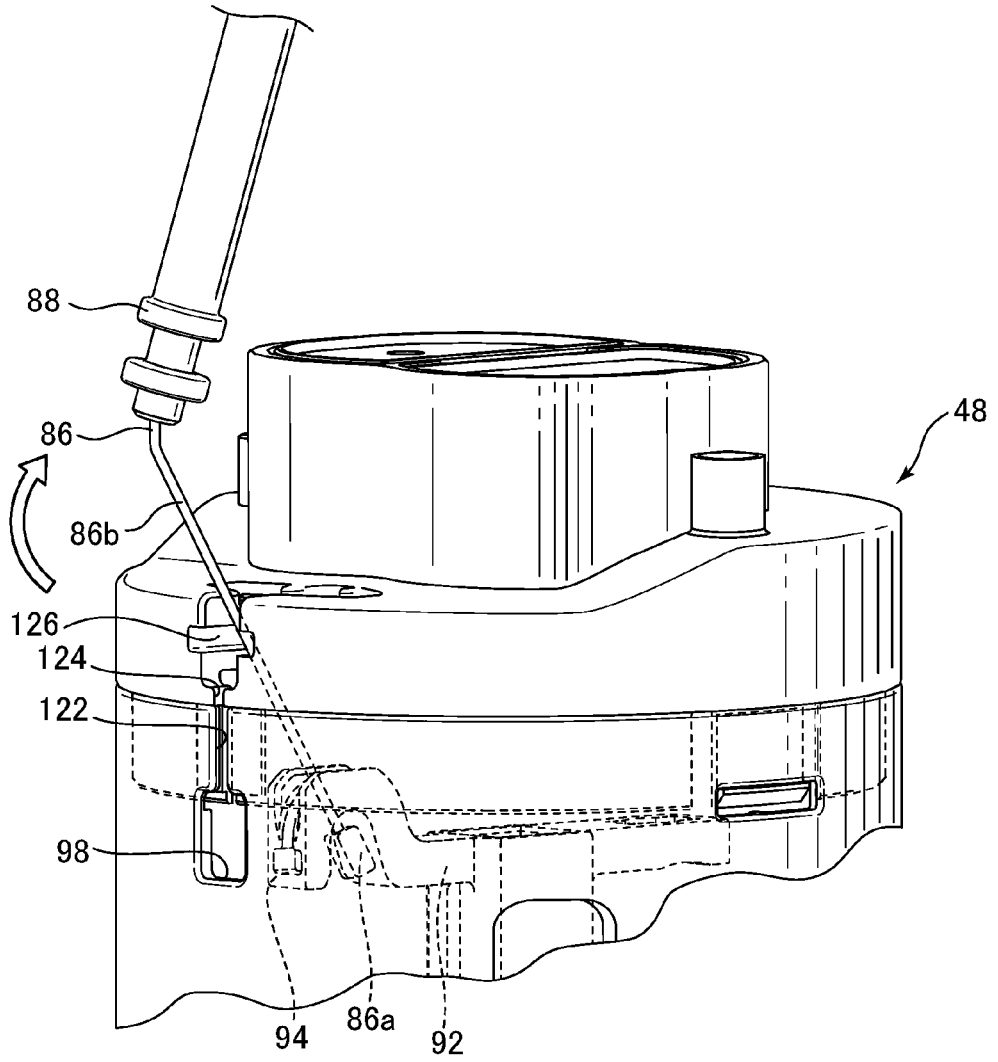
FIG. 16 is a diagram showing the appearance when, after an operating wire end portion is passed through a valve body-side attachment hole, it is then passed through the interior of a side wall slit, an internal first slit, and an internal second slit, in a discharge valve apparatus according to a first embodiment of the invention.
Figure 17:
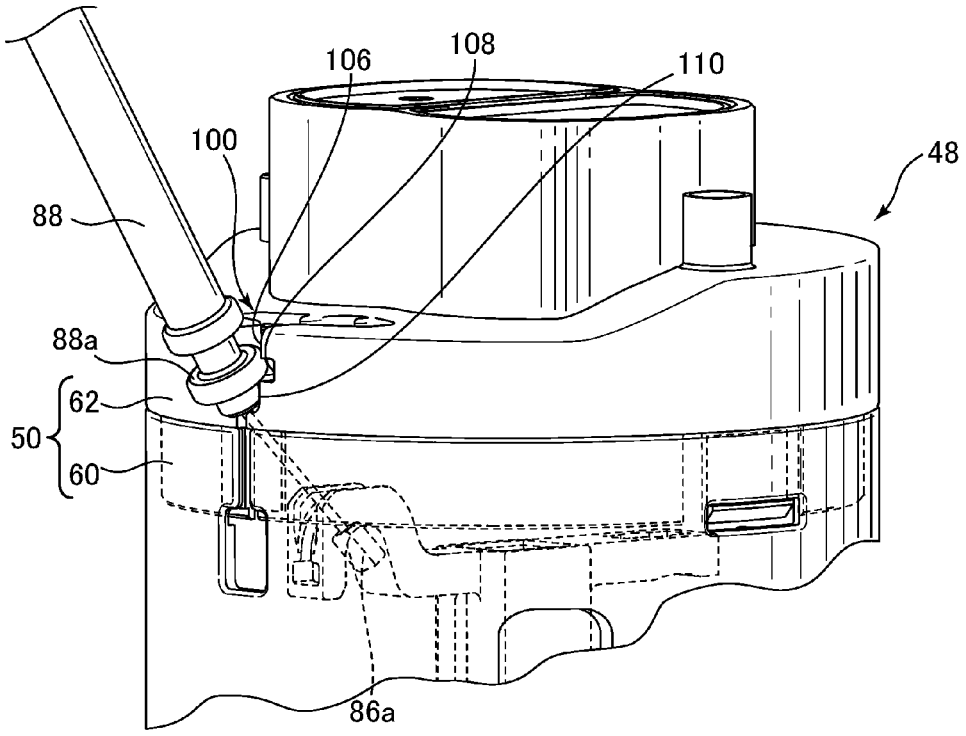
FIG. 17 is a diagram showing the appearance when a first flange portion on a tube is inserted into a wide width channel portion disposed on the peak portion of the tube first flange portion, and the tube is attached from the side to a tube attachment portion, in a discharge valve apparatus according to a first embodiment of the invention.
Figure 18:
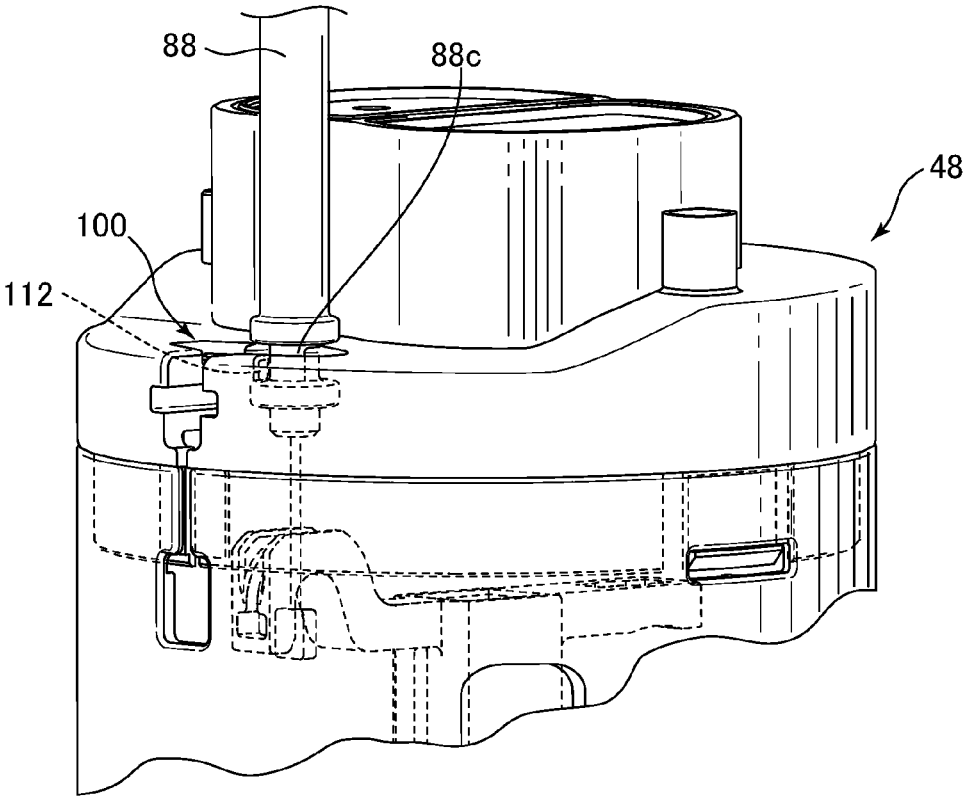
FIG. 18 is a diagram showing the state in which a tube is inserted up to attachment position A inside a tube attachment portion, in a discharge valve apparatus according to a first embodiment of the invention.
Figure 19:
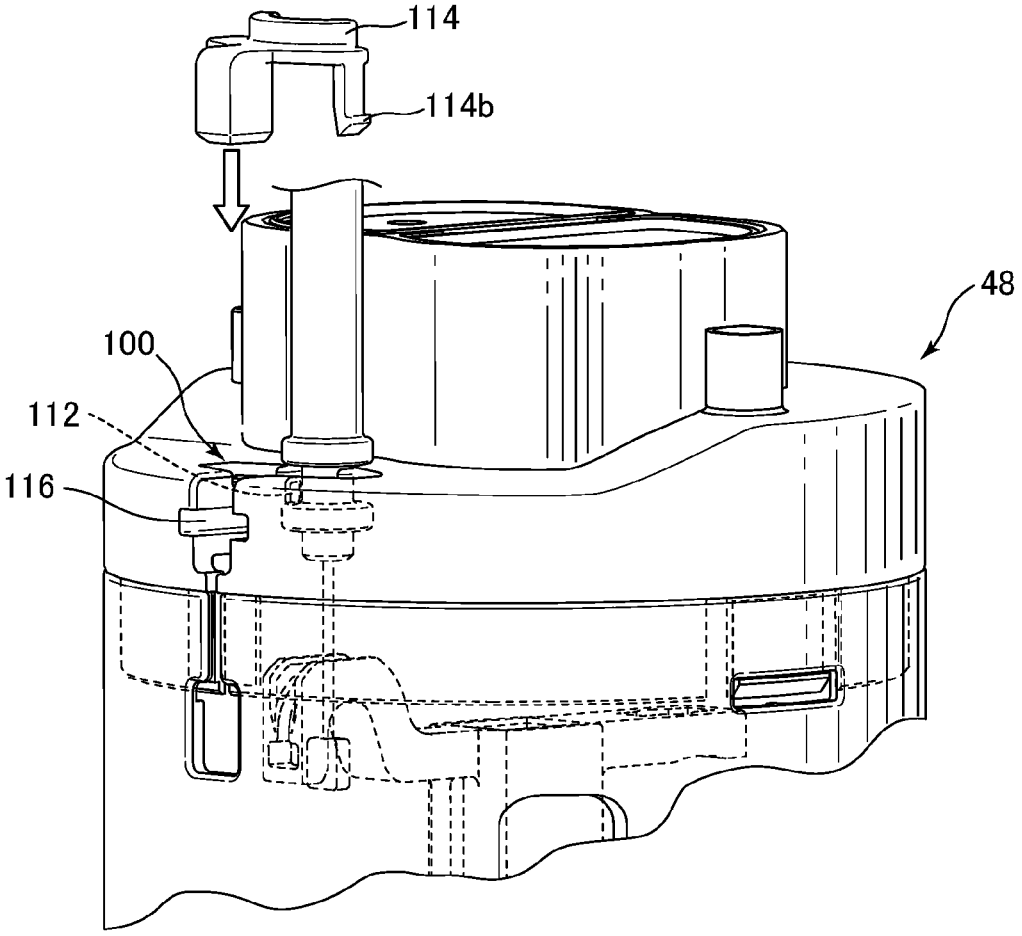
FIG. 19 is a diagram showing a step for attaching a tube pull-out stop member to a tube pull-out stop member attachment portion, in a discharge valve apparatus according to a first embodiment of the invention.

FIG. 12 is a diagram showing a step for disconnecting a discharge main body upward from a discharge port portion in a discharge valve apparatus according to a first embodiment of the invention, and FIG. 13 is a diagram showing a step for inserting an operating wire from outside the discharge valve main body casing toward a casing attachment hole, with the valve body portion raised up to a position at which the valve body-side attachment hole and the casing attachment hole portion are aligned in essentially a straight line, in a discharge valve apparatus according to a first embodiment of the invention. Also, FIG. 15 is a diagram showing the operating wire end portion inserted laterally into the valve body-side attachment hole on the valve body portion, in a discharge valve apparatus according to a first embodiment of the invention; FIG. 16 is a diagram showing the appearance when, after an operating wire end portion is passed through a valve body-side attachment hole, it is then passed through the interior of a side wall slit, an internal first slit, and an internal second slit, in a discharge valve apparatus according to a first embodiment of the invention. In addition, FIG. 17 is a diagram showing the appearance when a first flange portion on a tube is inserted into the wide width channel portion disposed on the peak portion of the tube first flange portion, and the tube is attached from the side to a tube attachment portion, in a discharge valve apparatus according to a first embodiment of the invention; FIG. 18 is a diagram showing the state in which a tube is inserted up to attachment position A inside a tube attachment portion, in a discharge valve apparatus according to a first embodiment of the invention; and FIG. 19 is a diagram showing a step for attaching a tube pull-out stop member to a tube pull-out stop member attachment portion, in a discharge valve apparatus according to a first embodiment of the invention.

As shown in FIG. 13, from the start the discharge valve apparatus 28 according to a first embodiment of the invention had a pull-up mechanism 54 corresponding to a push-button-type of manual operation apparatus 18, with which a user could open and close the valve body 64 to flush a flush toilet. However, the discharge valve apparatus 28 has still not attached the wire pull-up operating apparatus 82, which is a powered operating apparatus for automatic flushing.

Persons seeking to retrofit still another wire pull-up operating apparatus 82 to a discharge valve apparatus 28 according to a first embodiment of the invention will prepare the wire pull-up operating apparatus 82 which is to be attached.

First, as shown in FIG. 13, in a discharge valve apparatus 28 according to a first embodiment of the invention a discharge main body 48 is disconnected by pulling upward from a discharge port portion 53, disposed on the perimeter of the discharge valve apparatus 28 discharge port 10.

Figure 14:
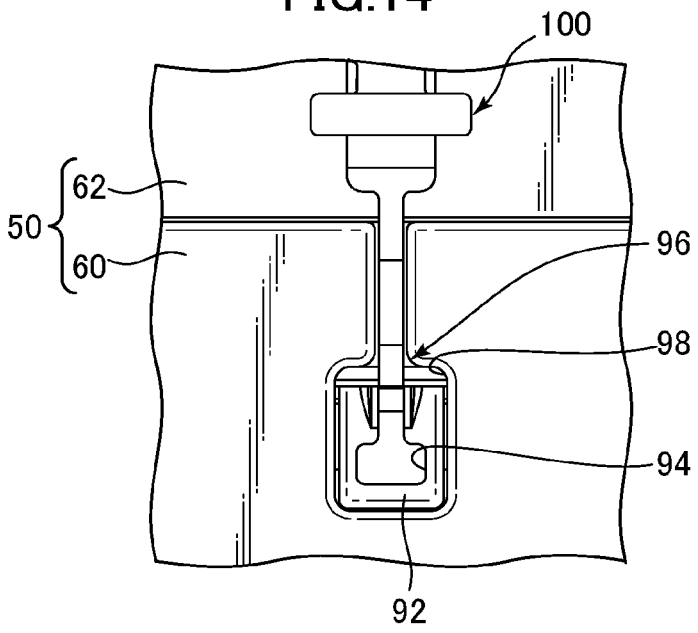
FIG. 14 is a diagram showing the appearance with the valve body portion raised of the valve body-side attachment hole and the casing-side attachment hole aligned in an essentially straight line form, visible from outside the casing-side attachment hole, in a discharge valve apparatus according to a first embodiment of the invention.

Next, as shown in FIGS. 14 and 15, the valve body portion 52 is raised to a position at which the valve body-side attachment hole 94 formed on the valve body portion 52 valve body-side attachment hole portion 92 and the casing attachment hole 98 formed on the casing 50 are aligned in an essentially straight line (i.e., a position at which the valve body-side attachment hole portion 92 can be seen from the casing attachment hole 98). For example, the valve body portion 52 may be raised to a position at which the valve body-side attachment hole 94 and the casing attachment hole 98 face one another.

In this state, as shown in FIG. 14, the end portion 86*a* of the operating wire 86 extending from the tip of the tube 88 is inserted in a straight line lateral direction from the outside of the discharge main body 48 toward the casing attachment hole 98 and the valve body-side attachment hole 94. Therefore an installer can pass the end portion 86*a* through the relatively small opening portion in the valve body-side attachment hole 94 while visually confirming the valve body-side attachment hole 94.

In addition, as shown in FIG. 16, an operating wire 86 end portion 86*a* which has passed through the casing attachment hole 98 is then further inserted into the valve body-side attachment hole 94 and made to pass through the valve body-side attachment hole 94.

Next, with respect to the operating wire 86 end portion 86*a*, as shown in FIG. 17, the operating wire 86 is raised upward, kept as is after being passed through the valve body-side attachment hole 94.

At this point, when the operating wire 86 is pulled up the wire part 86*b* of the operating wire 86 is raised on the side surface as it is passed through the side surface slit 122, then is raised toward the inside while being passed through the internal first slit 124, then is finally moved to the operating wire 86 attachment position A while being passed through the internal second slit 126.

Note that the wire part 86*b* close to the operating wire 86 end portion 86*a* inserted into the valve body-side attachment hole 94 can now ultimately be moved to the horizontal position of the operating wire 86 attachment position A as it passes through the valve body-side slit portion 102 (see FIG. 10). The end portion 86*a* is prevented from again pulling out and separating from the valve body-side attachment hole 94 by the raising of the operating wire 86 end portion 86*a* as it moves from the valve body-side attachment hole 94 to the valve body-side slit portion 102 side.

Next, as shown in FIGS. 18 and 19, the tube 88 is inserted so as to slide to the tube attachment portion 100 from the side of the casing 50.

More specifically, the tube 88 first flange portion 88*a* is inserted from the side, fitting the wide width channel portion 108. The tube 88 tube part 88*c* is inserted from the side, fitting the first narrow width channel portion 106. Also, the tube 88 tube part 88*d* is inserted from the side, fitting the second narrow width channel portion 110.

The entire tube 88 is moved along each of the channel portions in the tube attachment portion 100 in the horizontal direction toward the attachment position A.

Next, as shown in FIG. 19, the tube 88 tube part 88*c* is pushed in so as to pass over the projecting portion 112 (see FIG. 8) and advance up to attachment position A, which is closer to the center than the projecting portion 112. By disposing the tube 88 so that it passes over the projecting portion 112, the tube 88 can be prevented from easily falling out of the tube attachment portion 100.

Finally, as shown in FIG. 19, the tube pull-out stop member 114 is engaged by the tube pull-out stop member attachment portion 116 formed by each of the channel portions, further outside than the part where the tube 88 is positioned inside the tube attachment portion 100. The tube pull-out stop member 114 is locked to the locking hole 120 by the tab portion 114*b*.

In this manner the end portion 86*a* can be attached to the valve body-side attachment hole portion 92 of the valve body portion 52, and the tube 88 can be affixed to the discharge main body 48.

In a discharge valve apparatus 28 according to a first embodiment of the invention, the discharge main body 48 attachment portion 90 can removably attach the operating wire 86 extending from the wire pull-up operating apparatus 82 to a valve body portion 52 disposed on the interior of the discharge main body 48 casing 50.

Therefore when a wire pull-up operating apparatus 82 is added and attached from behind to a discharge valve apparatus 28, for example, the operating wire 86 can be conveniently and accurately attached to a valve body portion 52 disposed inside a discharge main body 48 casing 50. Also, when removing the discharge valve apparatus 28 from the wire pull-up operating apparatus 82 for repair or replacement, for example, after the operating wire 86 is removed from the valve body portion 52 disposed inside the discharge main body 48 casing 50 and the discharge valve apparatus 28 is removed from the operating apparatus 82 and repaired or replaced, the operating wire 86 on the same operating apparatus 82 can be conveniently and accurately attached to a valve body portion 52 disposed inside the casing 50 on the same or a different discharge valve apparatus 28 discharge main body 48.

Therefore an operating wire 86 extending from a wire pull-up operating apparatus 82 can be conveniently and accurately connected to a valve body portion 52 inside a discharge valve apparatus 28 casing 50.

Also, using a discharge valve apparatus 28 according the present embodiment, the operating wire 86 end portion 86*a* is inserted from the outside through the casing-side attachment hole portion 96 casing attachment hole 98 into the valve body-side attachment hole 94, and is attached to the valve body-side attachment hole portion 92 placed on the upper portion of the valve body portion 52 shaft. Hence the discharge main body 48 attachment portion 90 can removably attach the operating wire 86 extending from the wire pull-up operating apparatus 82 to the valve body-side attachment hole portion 92 disposed on the top portion of the valve body portion 52 disposed on the interior of the casing 50 of the discharge main body 48. Therefore an operating wire 86 extending from a wire pull-up operating apparatus 82 can be conveniently and accurately connected to a valve body portion 52 inside a discharge valve apparatus 28 casing 50.

Moreover, using a discharge valve apparatus 28 according to the present embodiment, the tube attachment portion 100 of the attachment portion 90 can removably attach the tube 88 covering the operating wire 86 to the casing 50 on the discharge main body 48. Therefore the tube 88 covering the operating wire 86 extending from the wire pull-up operating apparatus 82 can be conveniently and accurately connected to the valve body portion 52 inside the discharge valve apparatus 28 casing 50.

Using the discharge valve apparatus 28 of the present embodiment, the projecting portion 112 on the tube attachment portion 100 of the attachment portion 90 can prevent the tube 88 from pulling out. Therefore the tube 88 covering the operating wire 86 extending from the wire pull-up operating apparatus 82 can be conveniently and reliably connected to the valve body portion 52 inside the discharge valve apparatus 28 casing 50.

In addition, using the discharge valve apparatus 28 according to the present embodiment the tube pull-out stop member 114 on the tube attachment portion 100 of the attachment portion 90 can prevent the tube part 88*c* from pulling out. Therefore the tube 88 covering the operating wire 86 extending from the wire pull-up operating apparatus 82 can be conveniently and reliably connected to the valve body portion 52 inside the discharge valve apparatus 28 casing 50.

Using a discharge valve apparatus 28 according to the present embodiment, the casing attachment hole 98 on the casing-side attachment hole portion 96 of the attachment portion 90 and the valve body-side attachment hole 94 placed on the upper part of the valve body portion 52 shaft are in positions aligned in essentially a straight line when the valve body portion 52 is in a raised, predetermined position. Therefore the end portion 86*a* of the operating wire 86 can be inserted from the outside through a casing attachment hole 98 in a straight line manner into the valve body-side attachment hole 94. Hence the discharge main body 48 attachment portion 90 can removably attach the operating wire 86 extending from the wire pull-up operating apparatus 82 to the valve body portion 52 disposed on the interior of the discharge main body 48 casing 50.

In addition, by using a discharge valve apparatus 28 according to the present embodiment, a first flange portion 88*a*, in which the outside diameter of the tube 88 is at least partly expanded to be larger than the tube part 88*c*, can be inserted and attached inwardly from the side surface of the peak portion of the casing 50 into the wide width channel portion 108, and the tube part 88*c* extending from the first flange portion 88*a* can be inserted and attached inwardly from the side surface of the peak portion of the casing 50 into the first narrow width channel portion 106. Hence the tube attachment portion can removably attach the tube which covers the operating wire to the discharge main body casing. Therefore the tube covering the operating wire extending from the wire pull-up operating apparatus can be conveniently and accurately connected to the valve body portion inside the discharge valve apparatus casing.

Also, by using a discharge valve apparatus 28 according to the present embodiment, after inserting the end portion of the operating wire 86 from outside into the valve body-side attachment hole 94 through the casing attachment hole 98, the operating wire 86 can move from the casing attachment hole 98 through the casing-side slit portion 104 up to the operating wire 86 attachment position, and the operating wire 86 can move from the valve body-side attachment hole 94 through the valve body-side slit portion 102 up to the operating wire 86 attachment position A.

Therefore after the operating wire 86 end portion 86*a* is inserted from the outside through the casing attachment hole 98 into the valve body-side attachment hole 94, the operating wire 86 can be moved so as to change orientation, from above the casing attachment hole 98 and valve body-side attachment hole 94, to above the attachment position A, resulting in a state whereby the operating wire 86 is at the attachment position A, so that the operating wire 86 can pull up the valve body-side attachment hole portion 92 disposed on the valve body portion 52.

Moreover, using the flush water tank apparatus 4 according to the present embodiment, a flush water tank apparatus 4 can be provided with which the operating wire 86 extending from the wire pull-up operating apparatus 82 can be conveniently and accurately connected to the valve body portion 52 inside the discharge valve apparatus 28.

Also, using a flush toilet 1 according to the present embodiment, a flush toilet 1 can be provided with which the operating wire 86 extending from the wire pull-up operating apparatus 82 can be conveniently and accurately connected to the valve body portion 52 inside the discharge valve apparatus 28.

Next, referring to the FIGS. 20 through 28, we explain a discharge valve apparatus according to a first embodiment of the invention, a flush water tank including this discharge valve apparatus, and a flush toilet including this flush water tank apparatus.

Figure 20:
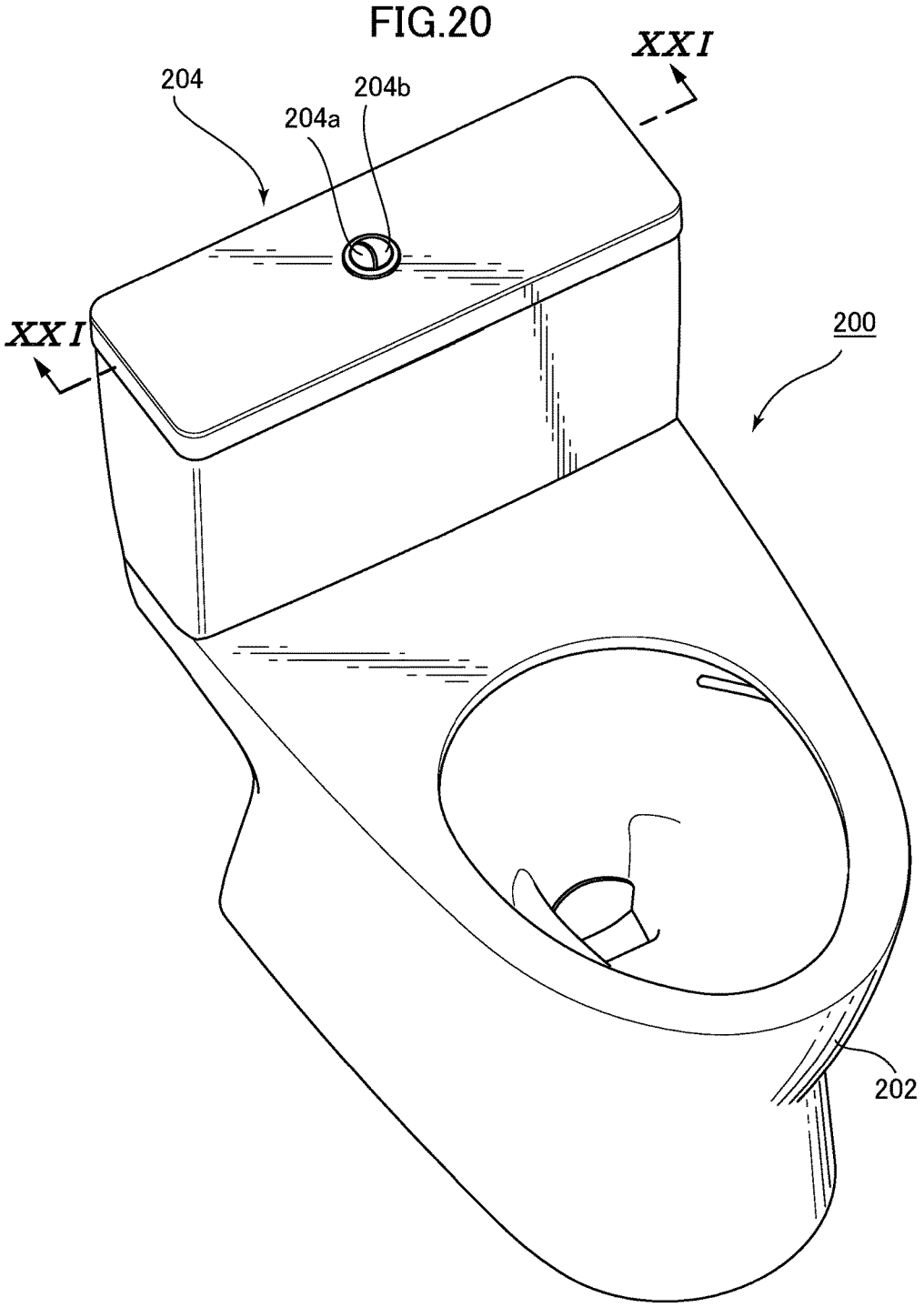
FIG. 20 is a summary diagram showing a flush toilet including a flush water tank apparatus to which a discharge valve apparatus according to a second embodiment of the invention is applied.

FIG. 20 is summary diagram showing a flush toilet including a flush water tank apparatus to which a discharge valve apparatus according to a second embodiment of the invention is applied.

As indicated in FIG. 20, a flush toilet 200 including a flush water tank apparatus to which a discharge valve apparatus according to a second embodiment of the invention has been applied, in turn supplies a toilet main body 202 and a cuboid flush water tank apparatus 204 disposed on the top surface at the rear side of this toilet main body 202.

By pressing a large flush button 204*a* or a small flush button 204*b* attached to the top surface of the flush water tank apparatus 204, flush water is supplied at a flow volume responsive to the flush type, from the flush water tank apparatus 204 to the toilet main body 202.

Figure 21:
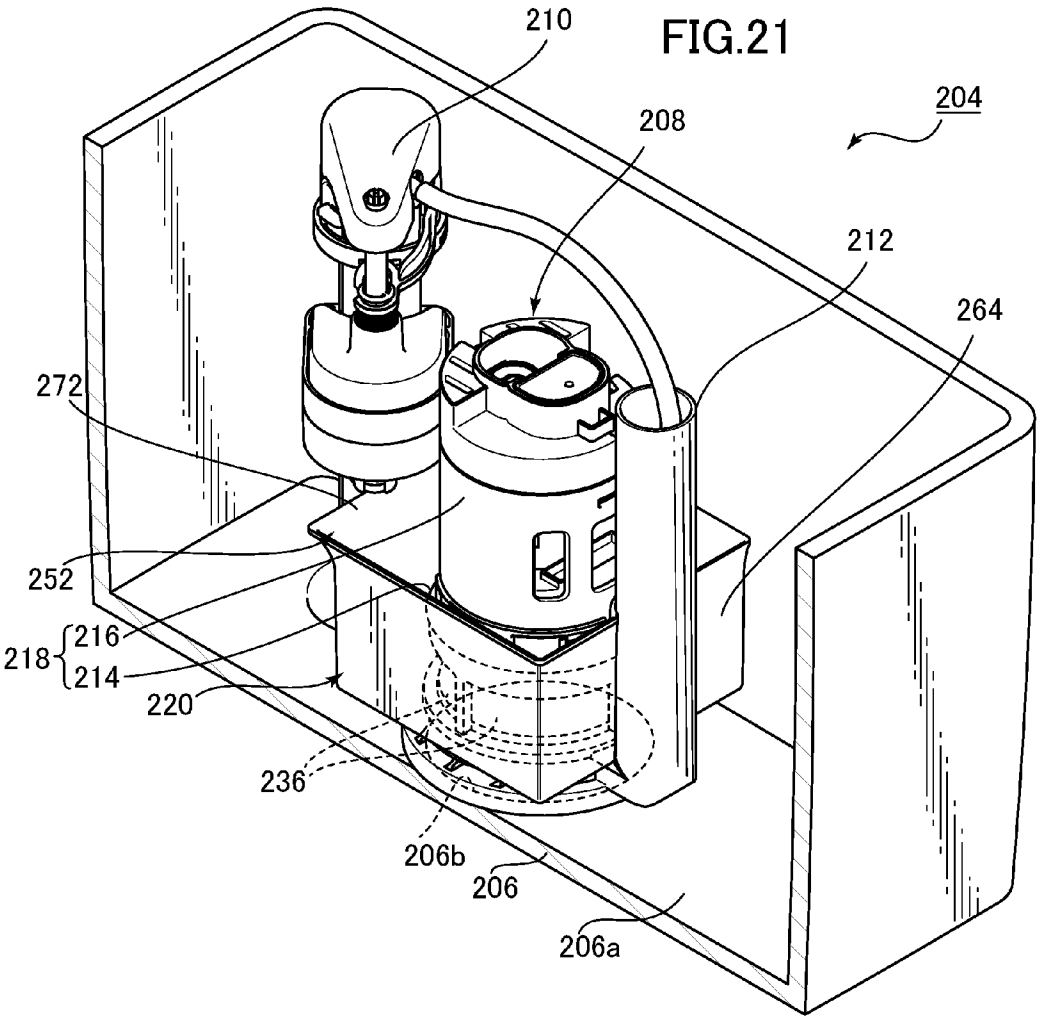
FIG. 21 is a cross sectional perspective view along line XXI-XXI in FIG. 20.

As shown in FIG. 21, the flush water tank apparatus 204 includes: a flush water tank 206; a discharge valve apparatus 208 according to a second embodiment of the invention, attached to the discharge port 206*b* formed on the bottom surface 206*a* of this flush water tank 206; and a water supply apparatus 210 mounted on the bottom surface of the flush water tank 206 for supplying flush water to the flush water tank 206.

Also, the discharge valve apparatus 208 includes an overflow pipe 212; flush water inside the flush water tank 206 flows out on the downstream side of the discharge valve apparatus 208 when it passes a specified water level corresponding to the top end position of the overflow pipe 212.

Next, referring to FIGS. 21 through 24, we explain the structure of a discharge valve apparatus according to a second embodiment of the invention.

Figure 22:
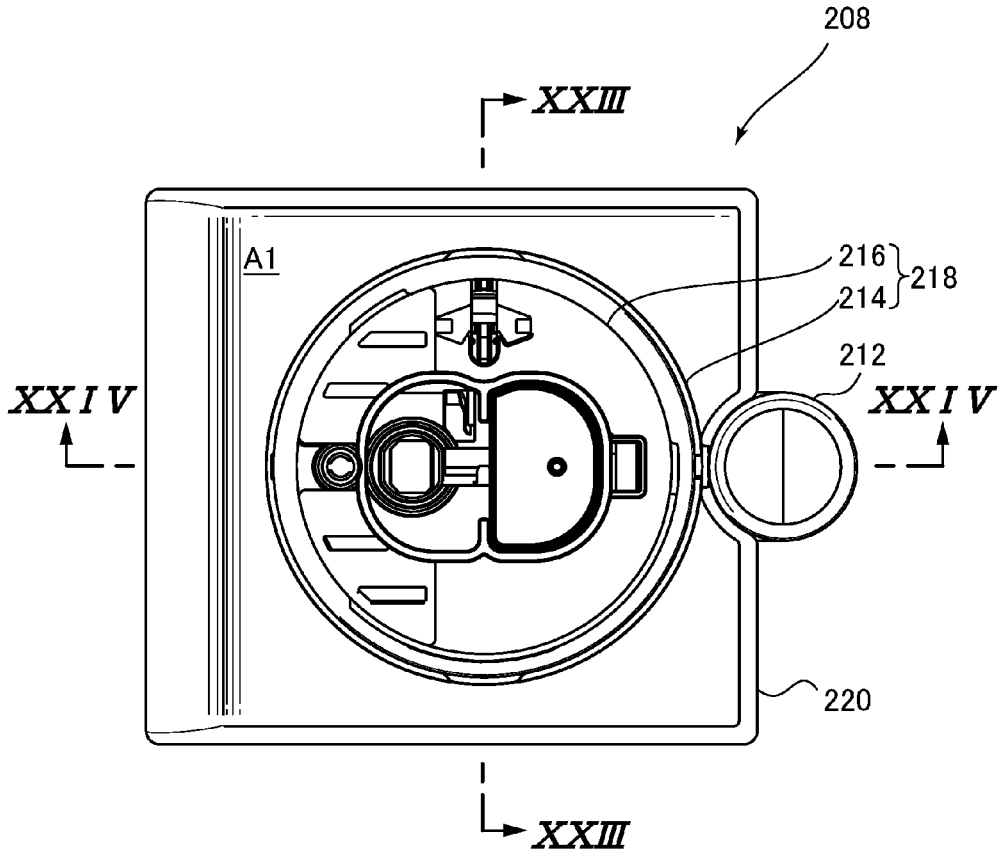
FIG. 22 is a plan view of a discharge valve apparatus according to a second embodiment of the invention.
Figure 23:
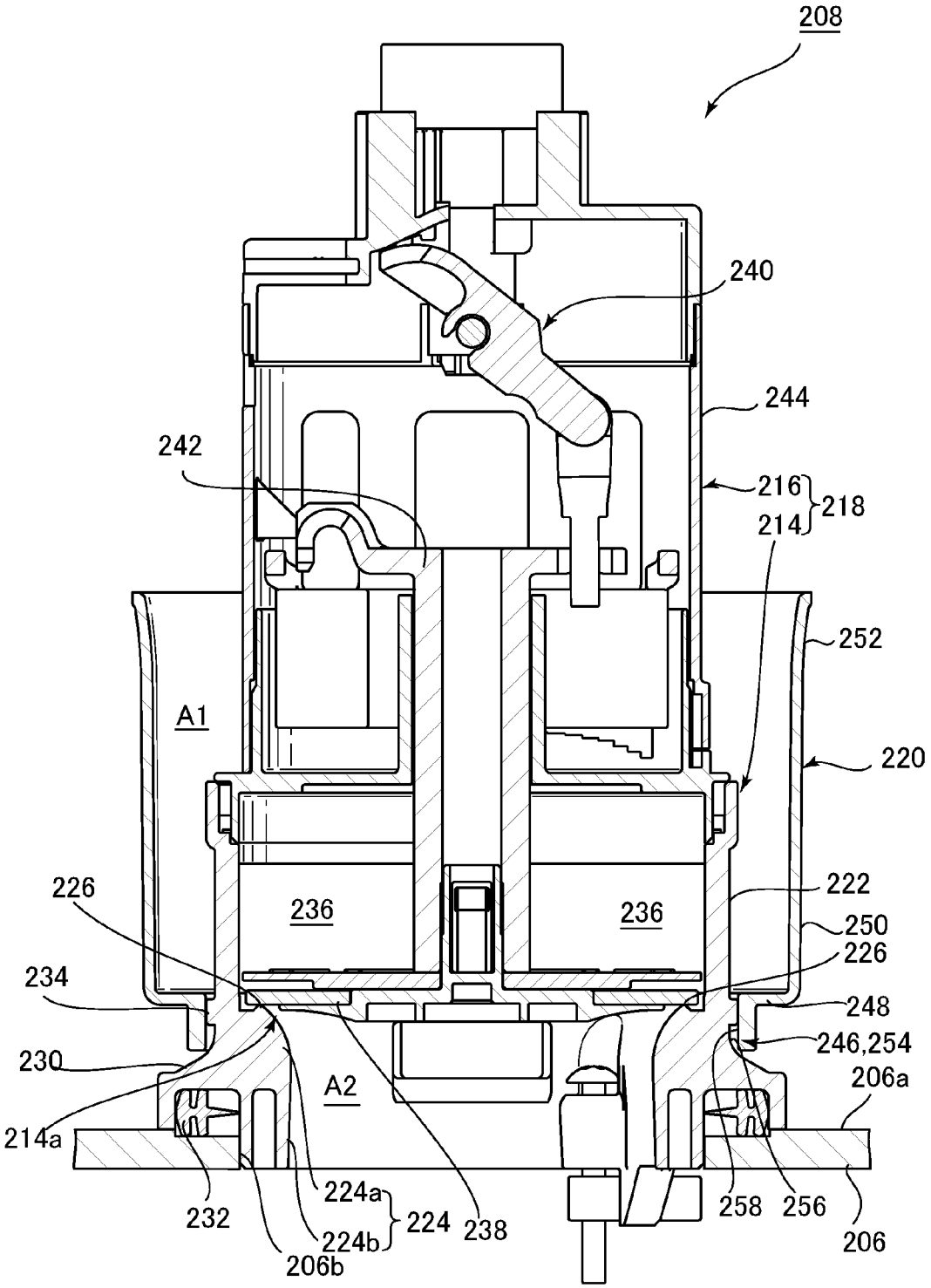
FIG. 23 is a cross sectional view along line XXIII-XXIII in FIG. 22.
Figure 24:
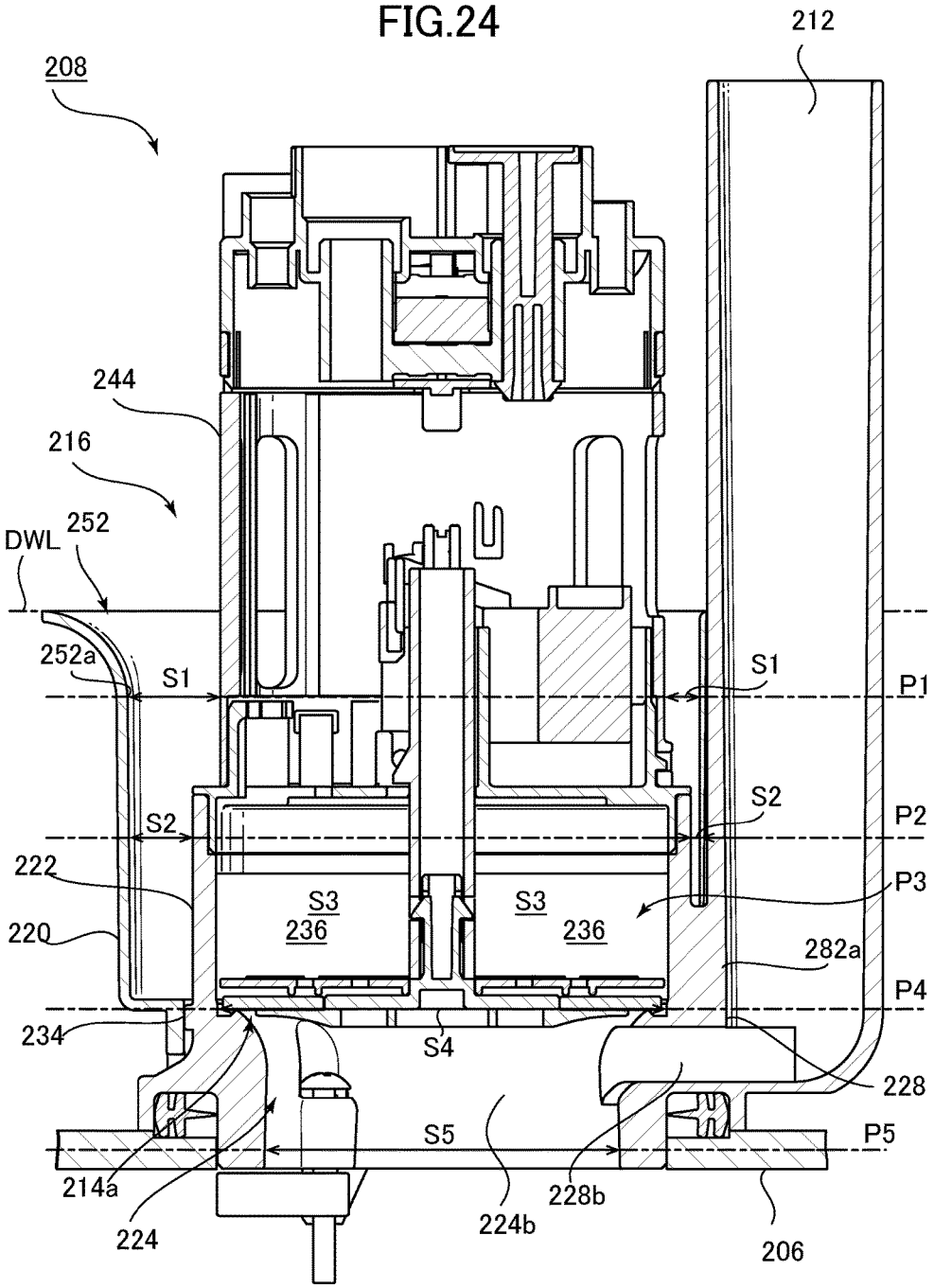
FIG. 24 is a cross sectional view along line XXIV-XXIV in FIG. 22.

FIG. 22 is a plan view of a discharge valve apparatus according to a second embodiment of the invention; FIG. 23 is a cross sectional view along line XXII-XXII in FIG. 22; FIG. 24 is a cross sectional view along line XXIV-XXIV in FIG. 22.

As shown in FIGS. 21 through 24, the discharge valve apparatus 208 includes a main body portion 218 including a discharge port portion 214 attached to the discharge port on the flush water tank 206 and a discharge valve portion 216 for opening and closing this discharge port portion 214; and a generally cup-shaped cylindrical body 220 attached to the discharge port portion 214.

As shown in FIG. 23, the discharge port portion 214 includes: a generally cylindrical discharge port portion main body 222 attached to a discharge port 206*b* penetrating the bottom surface 206*a* of the flush water tank 206; a discharge path-forming portion 224, including a reduced diameter portion 224*a* for reducing the diameter of this discharge port portion main body 222 inside and downward, and forming a discharge path 224*b* extending so as to penetrate the discharge port 206*b* of the flush water tank 206 downward from the reduced diameter portion 224*a*; and a valve seat 226 formed in a generally ring shape along the top edge of the reduced diameter portion 224*a*, and projecting upward. This region on the inside perimeter side of the valve seat 226 substantially forms a discharge port 214*a* on the discharge port portion 214, and this discharge port 214*a* corresponds to the discharge port from which flush water in the flush water tank 206 is discharged to the toilet main body 202 side.

Also, as shown in FIG. 24, the discharge port portion 214 is disposed to integrally connect the lower part of the overflow pipe 212 and the discharge port portion main body 222, and includes an overflow pipe connecting portion 228 joining the discharge path 224*b* and the overflow pipe 212.

As shown in FIG. 23, the bottom end of the discharge port portion main body 222 is inserted into the discharge port 206*b* on the flush water tank 206, and a flange portion 230 is formed on the lower outer perimeter of the discharge port portion main body 222. This flange portion 230, by crimping the ring-shaped packing 232 using the bottom surface 206*a* of the flush water tank 206 on the lower side thereof, prevents flush water stored in the flush water tank 206 from flowing out from the gap between the first rim spout opening 22 and the flush water tank 206 bottom surface 206*a* or the discharge port 206*b*.

Also, as shown in FIGS. 23 and 24, an outwardly projecting portion 234 is formed in a band over the entire perimeter on the attachment portion of the outer perimeter surface of the discharge port portion main body 222 to which the attachment portion of the cylindrical body 220 (the bottom side opening portion 246 described in detail below) is attached.

Furthermore, as shown in FIGS. 21, 23, and 24, multiple communicating ports 236 are formed in the perimeter direction in the region above the valve seat 226 on the discharge port portion main body 222, and the opening cross section of each of the communicating ports 236 is formed in a rectangular shape as seen in the side elevation shown in FIG. 23, and as seen in the front elevation shown in FIG. 24.

Each of the communicating ports 236, as shown in FIGS. 22 and 23, enables communication between a first area A1 on the inside of the discharge port portion main body 222 and the outside of the main body portion 218, and a second area A2 inside the discharge port portion 214, and when the flush water level inside the flush water tank 206 is positioned above the top edge of the cylindrical body 220, flush water flowing into the cylindrical body 220 flows from each of the communicating ports 236 into the discharge port portion 214.

The discharge port portion 214 overflow pipe connecting portion 228 includes a rib 228*a* for structurally connecting the overflow pipe 212 and the discharge port portion 214, and a communication path 228*b* for fluidly connecting the interior of the overflow pipe 212 with the interior of the discharge port portion 214; the overflow pipe 212 and the discharge port portion 214 are thus integrally formed as a single piece.

As shown in FIG. 23, the discharge valve portion 216 includes a disk-shaped valve body 238 for opening and closing the discharge port portion 214 by contacting the discharge port portion 214 valve seat 226.

The discharge valve portion 216 also includes a main shaft member 242, on the bottom end of which a valve body 238 is disposed, and the top end of which is linked to a link mechanism 240 connecting the large flush button 204*a* and the small flush button 204*b*.

In addition, the discharge valve portion 216 includes a cylindrical casing 244, which covers the valve body 238 and the main shaft member 242 and forms the external appearance of the discharge valve portion 216.

Next, referring to FIGS. 23 through 28, we explain the cylinder body structure of a discharge valve apparatus according to a second embodiment of the invention.

Figure 25:
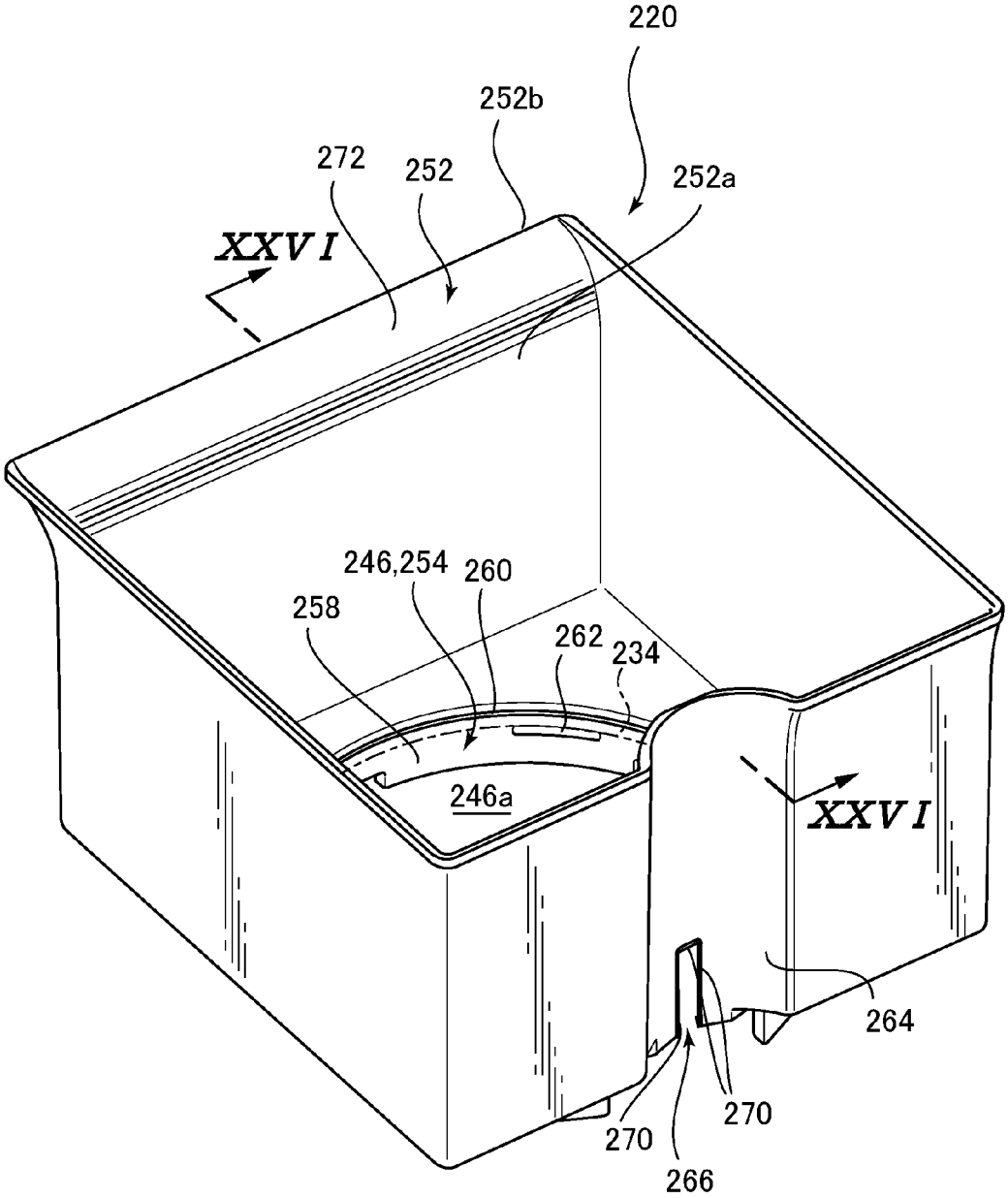
FIG. 25 is a perspective view from diagonally above of a cylindrical body in a discharge valve apparatus according to a second embodiment of the invention.
Figure 26:
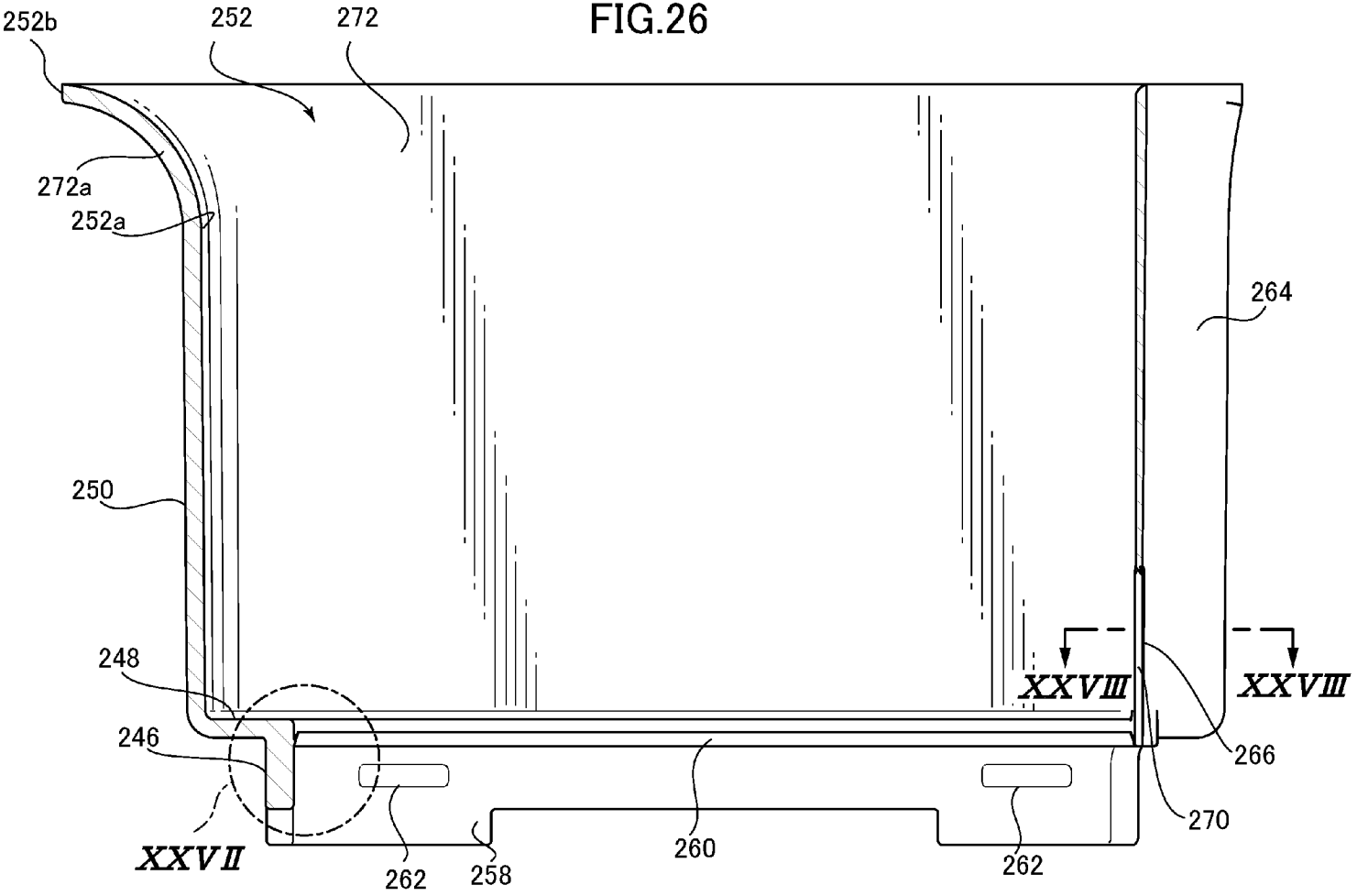
FIG. 26 is a cross sectional view along line XXVI-XXVI in FIG. 25.
Figure 27:
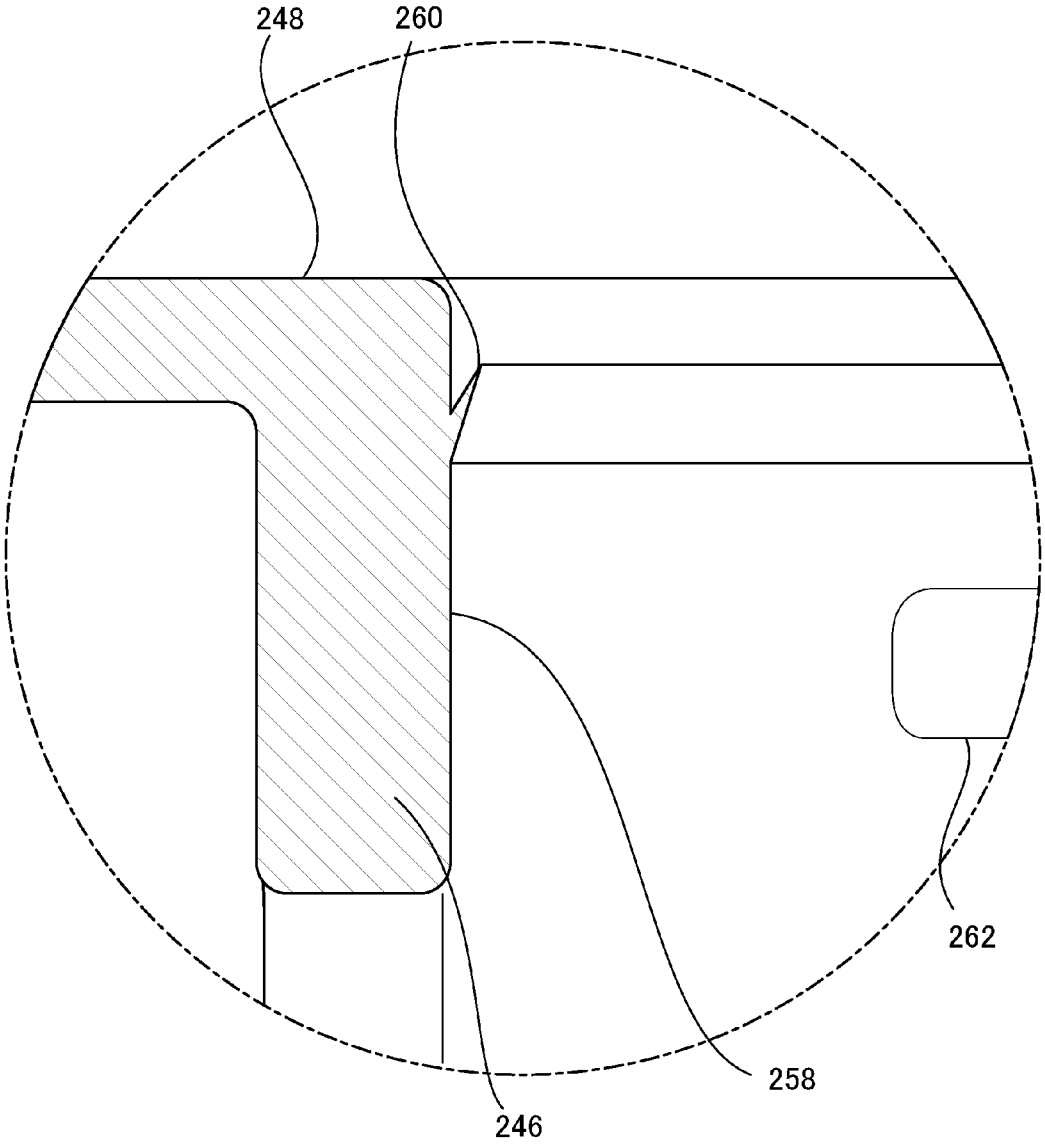
FIG. 27 is a partial expanded view in which the XXVII portion of FIG. 26 is partially expanded.
Figure 28:
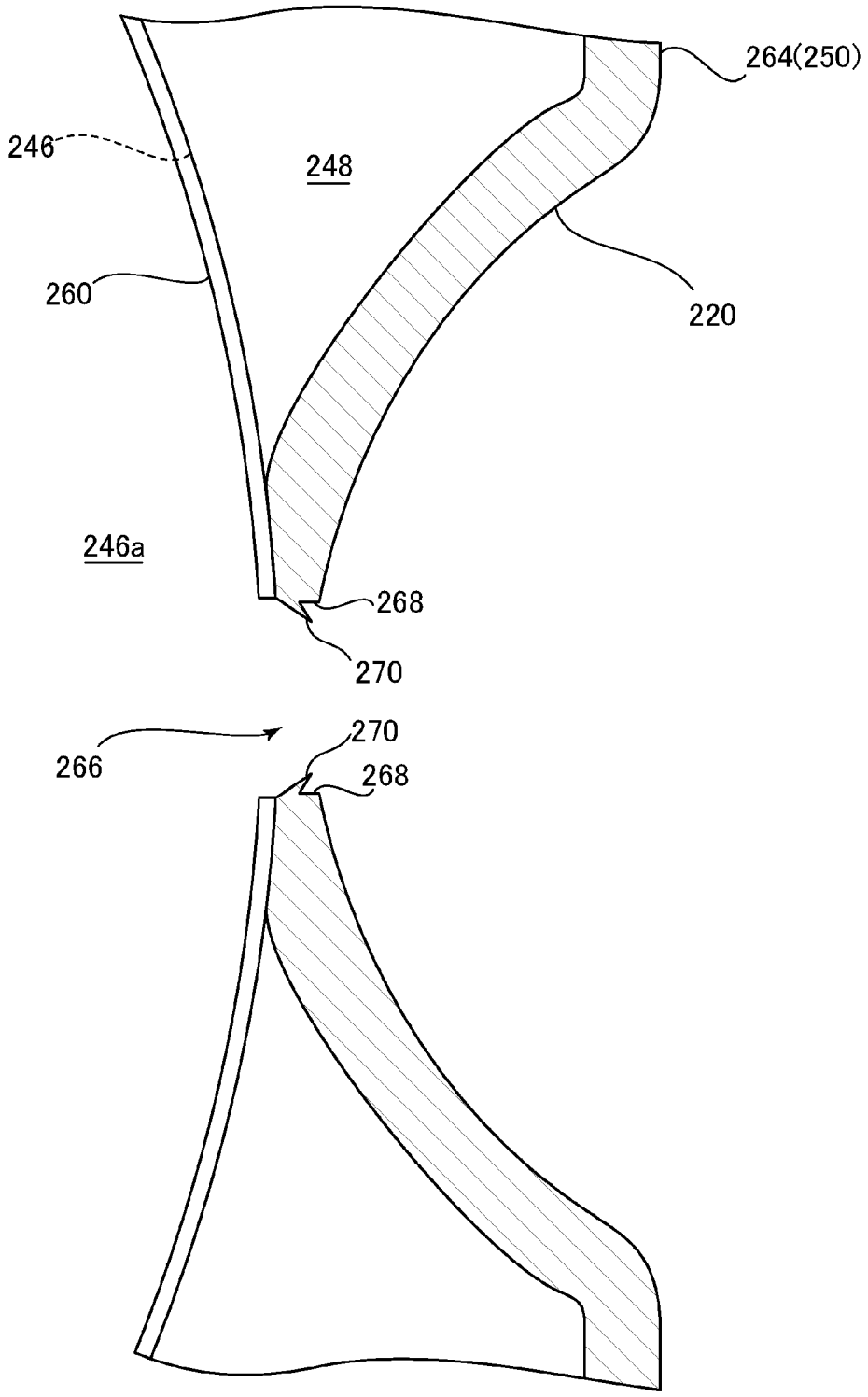
FIG. 28 is a cross section seen along line XXVIII-XXXVIII in FIG. 26.

FIG. 25 is a perspective view from diagonally above of a cylindrical body in a discharge valve apparatus according to a second embodiment of the invention; FIG. 26 is a cross sectional view along line XXVI-XXVI in FIG. 25; FIG. 27 is a partial expanded view in which the XXVII portion of FIG. 26 is partially expanded; and FIG. 28 is a cross section seen along line XXVIII-XXXVIII in FIG. 26.

As shown in FIGS. 23 and 26, the cylindrical body 220 includes: a bottom side opening portion 246 engaging and attached to the discharge port portion 214 of the main body portion 218 attached to the discharge port 206*b* of the flush water tank 206; a bottom surface portion 248 projecting out from this bottom side opening portion 246 on the outer perimeter side and forming the bottom surface of the of the cylindrical body 220; side wall portions 250 extending upward from this bottom surface portion 248 and surrounding the outside perimeter of the main body portion 218; and an upper opening portion 252 contiguous with the top end portion of these side wall portions 250.

Because the bottom side opening portion 246 is fit into the generally cylindrical discharge port portion main body 222 from the outside, the cross section thereof is essentially circular in shape when viewed in plan view, and forms a part of the attachment portion 254 of the cylindrical body 220 attached to the main body portion 218.

As shown in FIGS. 23 and 26, a first attachment surface 258 opposing the outside perimeter surface 256 of the discharge port portion 214 is formed on the inner perimeter side of the bottom side opening portion 246; and a first tab portion 260 serving as an infiltration-preventing portion for preventing the intrusion of flush water from outside the cylindrical body 220 into the interior of the cylindrical body 220 is formed on this first attachment surface 258.

This first tab portion 260 projects upward and can deform when the cylindrical body 220 is attached to the discharge port portion 214, sealing off the gap between the first attachment surface 258 and the outside perimeter surface 256 of the discharge port portion 214.

Note that in the present embodiment the first tab portion 260 is formed over the entire perimeter of the first attachment surface 258 of the bottom side opening portion 246, but this first tab portion 260 may also be formed at spaced intervals along the perimeter direction of the first attachment surface 258 on the bottom side opening portion 246.

Moreover, multiple (four) projections 262, projecting inward, which is the center direction, rectangular as viewed in front elevation, are formed at intervals in the perimeter direction; these projections 262 can engage the projecting portion 234 of the discharge port portion 214 when the cylindrical body 220 is attached to the discharge port portion 214.

Note that the number of projections 262 is not limited to four if they are formed multiply on the first attachment surface 258.

One end of the bottom surface portion 248 is smoothly connected to a bottom side opening portion 246; the other end is smoothly connected to side wall portions 250.

Also, the side wall portions 250, as shown in FIG. 23, oppose one another, separated by a distance from the discharge port portion main body 222 of the discharge port portion 214 and the casing 244 of the discharge valve portion 216, and are slightly downwardly sloped.

The cylindrical body 220 is thus formed so that the flow path surface area in the first region A1 decreases in the downward direction.

Hence the flow path passing from the first region A1 through the communicating ports 236 and from the second region A2 to reach the discharge port portion 214 discharge port 214*a* is formed so that its flow path surface area diminishes more toward the downstream side.

Next, in FIG. 24, the flush water level inside the flush water tank 206 corresponding to the position of the height of the top edge 252*a* of the upper opening portion 252 on the cylindrical body 220 is indicated as the stopped water level (or dead water level) DWL.

The flow path cross sectional area for the first region A1 on the inside of the cylindrical body 220 at the height position P1 close to the bottom edge 252*b* of the upper opening portion 252 on the cylindrical body 220, and on the outside of the main body portion 218, is deemed flow path surface area S1, and the flow path cross sectional area for the first region A1 on the inside of the cylindrical body 220 below the height position P1 and at the height position P2 above the communicating ports 236, and outside the main body portion 218, is deemed flow path surface area S2.

In addition, in FIG. 24 at the height position P3 where each of the communicating ports 236 is formed below the height position P2, the total opening surface area of all the communicating ports 236 is shown by flow path surface area S3, and at the height position P4 of the discharge port 214*a* below each of the communicating ports 236, the opening cross sectional area of the discharge port 214*a* is shown by S4.

For FIG. 24, the flow path cross sectional area close to the bottom end of the discharge path 224*b* of the discharge path-forming portion 224 is shown by S5.

As shown in FIG. 24, each flow path surface area S1 through S5 is set to diminish in the downstream direction from position P1 to position P5.

Also, in the front-to-back center of the first side surface 264 facing the overflow pipe 212 on the side wall portions 250 of the cylindrical body 220 (see FIG. 21), the slit 266, which is the vertical length opening, is formed up to the bottom surface portion 248, and communicates with the opening 246*a* on the bottom side opening portion 246.

The formation of such a slit 266 on the side wall portions 250 results in the insertion of the rib 228*a* on the overflow pipe connecting portion 228 of the discharge port portion 214 into the slit 266 in the side wall portions 250 when the cylindrical body 220 is attached to the discharge port portion 214.

As shown in FIG. 28, a second attachment surface 268 facing the main body portion 218 of the discharge port portion 214 is formed on the slit 266 of the side wall portions 250 of the cylindrical body 220, and a second tab portion 270, being an infiltration-preventing portion for preventing the infiltration of flush water outside the cylindrical body 220 into the cylindrical body 220, is formed as a single piece on this second attachment surface 268.

This second tab portion 270 projects upward, deforming when the cylindrical body 220 is attached to the discharge port portion 214 so as to seal off the gap between the second attachment surface 268 and the rib 228*a* on the overflow pipe connecting portion 228 on the discharge port portion 214.

On the upper opening portion 252, as shown in FIGS. 25 and 26, a curved surface 272 is formed so as to separate from the main body portion 218 (i.e., the center of the cylindrical body 220) from the bottom end of the upper opening portion 252 toward the top end 252*b*.

Then, as shown in FIGS. 21 and 26, the curved surface 272 of the upper opening portion 252 forms a most curved maximum curved surface 272*a* at the top edge part (the left side top edge part of the upper opening portion 252 on the cylindrical body 220 as seen in front elevation) on the water supply apparatus 210 side of the upper opening portion 252 on the cylindrical body 220.

On the other hand, the top edge part other than the left side top edge part of the upper opening portion 252 on the cylindrical body 220, i.e., the front-to-back top edge part and the right side top edge part of the cylindrical body 220 upper opening portion 252, is virtually uncurved compared to the maximum curved surface 272*a* at the left side top edge part of the cylindrical body 220 upper opening portion 252.

Note that in the present embodiment, as shown in FIGS. 21 and 26, we explain the mode in which the maximum curved surface 272*a* of the curved surface 272 on the upper opening portion 252 is disposed only on the top edge part (the left side top edge part of the cylindrical body 220 upper opening portion 252 as seen in front elevation) of the water supply apparatus 210 side of the cylindrical body 220 upper opening portion 252, but in cases where surrounding space in the cylindrical body 220 front-to-back direction surrounding overflow pipe 212 in the flush water tank 206 can be sufficiently secured, the same type of curved surface as the maximum curved surface 272*a* can also be disposed in the front-to-back top edge part or the right side top edge part of the upper opening portion 252.

Next, referring to FIGS. 23, 24, 27, and 29, we explain a method for attaching a cylindrical body in a discharge valve apparatus according to a second embodiment of the invention.

First the bottom side part of the discharge port portion 214 of the main body portion 218 on the discharge valve apparatus 208 is inserted from above and affixed to the discharge port 206*b* of the flush water tank 206 in advance, and in this state a cylindrical body 220 selected according to flush water tank 206 specifications is attached from above to the discharge port portion 214 of the main body portion 218 on the discharge valve apparatus 208.

Specifically, by moving the pre-attachment cylindrical body 220 at a position above the main body portion 218 of the discharge valve apparatus 208 downward, it can be inserted to a position close to the lower projecting portion 234 under the discharge port portion main body 222 from the upper part of the discharge valve apparatus 208 main body portion 218 inside the opening 246*a* on the cylindrical body 220 bottom side opening portion 246. By moving the cylindrical body 220 downward relative to the main body portion 218 until the projections 262 on the inside perimeter side of the bottom side opening portion 246 on the cylindrical body 220 pass over the projecting portion 234 on the discharge port portion main body 222 of the main body portion 218 in the discharge valve apparatus 208, the inside perimeter side of the cylindrical body 220 bottom side opening portion 246 is fit onto the outside perimeter-side projecting portion 234 of the discharge port portion main body 222 of the discharge port portion 214 on the main body portion 218 of the discharge valve apparatus 208.

At this point, the cylindrical body 220 first tab portion 260 is crushed by the projecting portion 234 on the discharge port portion 214 and deforms, the gap between the cylindrical body 220 and the discharge port portion main body 222 is sealed off, and infiltration of flush water outside the cylindrical body 220 from the gap between the cylindrical body 220 and the discharge port portion main body 222 is prevented.

At the same time, the cylindrical body 220 second tab portion 270 is crushed by the rib 228*a* and deforms, the gap between the cylindrical body 220 and the connecting portion 228 is sealed off, and infiltration of flush water outside the cylindrical body 220 from the gap between the cylindrical body 220 and the overflow pipe connecting portion 228 is prevented.

Also, when the cylindrical body 220 bottom side opening portion 246 is fit into the discharge port portion 214 discharge port portion main body 222, the top end of the cylindrical body 220 projections 262 lock with the bottom end of the discharge port portion 214 projecting portion 234, strongly affixing the cylindrical body 220 to the main body portion 218.

This makes it possible to prevent the cylindrical body 220 from falling out of the discharge port portion 214 as a result of the buoyancy of flush water in the flush water tank 206.

Since a cylindrical body 220, selectable according to the specifications for the flush water tank 206, can in this manner be retrofitted to a main body portion 218 which has been pre-attached to a flush water tank 206, the selection of various types of cylindrical body 220 relative to a suitable main body portion 218 enables the easy setting of a specified water level such as a minimum water level (stopped water level (or dead water level) DWL) for flush water in the flush water tank 206, and of the flush water amount supplied to the toilet main body 202 side according to the flush water tank 206 specifications.

In addition, when flushing of the toilet main body 202 is started, and the discharge port 214*a* on the discharge port portion 214 is released by opening the valve body 238 on the main body portion 218 of the discharge valve apparatus 208, flush water in the flush water tank 206 flows into the cylindrical body 220 from the upper opening portion 252 of the cylindrical body 220, then is discharged from the discharge port portion 214 through the flush water tank 206 discharge port and discharged to the toilet main body 202, and the flush water level inside the flush water tank 206 drops.

When the flush water level drops to below the top end 252*b* of the upper opening portion 252 on the cylindrical body 220, flush water stops flowing from the cylindrical body 220 upper opening portion 252 to its interior, therefore the water level inside the flush water tank 206 can be stopped at the stopped water level (or dead water level) DWL inside the flush water tank 206.

Therefore simply by retrofitting a cylindrical body 220 selected according to flush water tank 206 specifications to the main body portion 218, the specified water level in the flush water tank 206 (stopped water level (or dead water level) DWL) can be easily set, and the amount of flush water supplied from the flush water tank 206 to the toilet main body 202 can be easily adjusted.

Next, referring to FIGS. 23 and 24, we explain the operation of a discharge valve apparatus, a flush water tank including this discharge valve apparatus, and a flush toilet including this flush water tank apparatus according to a second embodiment of the invention.

First, when the large flush button 204*a* or the small flush button 204*b* are pressed, the link mechanism 240 is activated in response to this pressing, and the main shaft member 242 is pulled up.

The valve body 238 is thus pulled up by the main shaft member 242 and the valve opened by separation from the valve seat 226, and the reduced diameter portion 224*a* and discharge path 224*b* of the discharge path-forming portion 224 are released.

The flowing of flush water in the flush water tank 206 from the cylindrical body 220 upper opening portion 252 into the cylindrical body 220 causes flush water to be discharged from the discharge port portion 214 discharge port 214*a* through the reduced diameter portion 224*a* and the discharge path 224*b* of the discharge path-forming portion 224 to the toilet main body 202.

During the period when the flush water level in the flush water tank 206 is dropping to the position of the upper opening portion 252 on the cylindrical body 220, flush water in the flush water tank 206 flows from the cylindrical body 220 upper opening portion 252 into the cylindrical body 220.

At this point the cylindrical body 220 upper opening portion 252 is curved from the top edge 252*a* to the top end 252*b*, so sudden change in the flow path cross sectional area in the cylindrical body 220 from the relatively large flow path cross sectional area inside the flush water tank 206 is prevented, therefore pressure losses near the cylindrical body 220 upper opening portion 252 are prevented, and flush water flowing into the cylindrical body 220 upper opening portion 252 is able to smoothly flow into the cylindrical body 220 along the curved surface 272 of the upper opening portion 252.

When flush water flows into the cylindrical body 220, instantaneous drops in the flush water flow volume are effectively prevented, therefore flush water can be efficiently supplied to the toilet main body 202.

As a result of the above, flushing performance of the toilet main body 202 can be improved, and flush water can be conserved.

Using the discharge valve apparatus 208 according to the above-described second embodiment of the invention, a curved surface 272 is formed on the cylindrical body 220 upper opening portion 252 from its top edge 252*a* to its top end 252*b* so as to separate from the main body portion 218, therefore when the flush water tank 206 discharge port portion 214 discharge port 214*a* is released by the opening of the valve body 238 on the main body portion 218 of the discharge valve apparatus 208, so that the water level in the flush water tank 206 drops, sudden changes from the relatively large flow path cross sectional area in the flush water tank 206 to the flow path cross sectional area in the cylindrical body 220 are prevented. Therefore pressure losses near the cylindrical body 220 upper opening portion 252 are prevented, and flush water flowing into the cylindrical body 220 upper opening portion 252 can smoothly flow along the curved surface 272 on the upper opening portion 252 of the cylindrical body 220 and into the cylindrical body 220.

When flush water flows into the cylindrical body 220, instantaneous drops in the flush water flow volume can be effectively prevented, therefore flush water can be efficiently supplied to the toilet main body 202.

As a result of the above, flushing performance of the toilet main body 202 can be improved, and flush water conservation can be achieved.

Also, using the discharge valve apparatus 208 according to the present embodiment, the cylindrical body 220 is formed so that the flow path cross sectional areas S1, S2 formed in the region A on the inside thereof and outside the main body portion diminish in the downward direction, therefore when flush water in the flush water tank 206 passes through the flow path in the region A1 on the inside of the cylindrical body 220 and outside the main body portion 218 after flowing from the upper opening portion 252 of the cylindrical body 220 into the cylindrical body 220, it becomes more difficult for the flow of flush water to peel away inside the flow path, and turbulence can be prevented.

Therefore drops in the instantaneous flush water flow volume can be prevented, and flush water can be efficiently supplied to the toilet main body 202, so the toilet main body 202 flushing performance can be improved and flush water can be conserved.

Moreover, using a discharge valve apparatus 208 according the present embodiment, the flow path from a first region A1 on the inside of the cylindrical body 220 and the outside of the main body portion 218 through the communicating ports 236, and from the second region A2 in the discharge port portion 214 to the vicinity of the bottom end of the discharge port 214*a* on the discharge port portion 214 and the discharge path 224*b* on the discharge path-forming portion 224 in the flush water tank 206, is formed so that the flow path cross sectional areas S1 through S5 thereof diminish in the downstream direction, therefore after flush water in the flush water tank 206 has flowed from the upper opening portion 252 into the cylindrical body 220, turbulence of flush water flow inside the flow path can be prevented when passing through the flow path from the first region A1 outside the main body portion 218 through the communicating ports 236, and from the second region A2 inside the discharge port portion 214 to the vicinity of the bottom end of the discharge port 214*a* in the discharge port portion 214 and the discharge path 224*b* of the discharge path-forming portion 224 in the flush water tank 206.

Therefore drops in the instantaneous flush water flow volume in these flow paths can be prevented, and flush water can be efficiently supplied to the toilet main body 202, so the toilet main body 202 flushing performance can be improved and flush water can be conserved.

Moreover, by using a flush water tank apparatus 204 according to the present embodiment, drops in the instantaneous flush water flow volume when flush water flows into the cylindrical body 220 can be prevented, and a flush water tank apparatus 204 capable of efficiently supplying flush water to the toilet main body 202 can be provided.

Hence a flush water tank apparatus 204 can be provided with which the toilet main body 202 flushing performance can be improved and flush water can be conserved.

Also, by using a flush toilet 200 according to the present embodiment, drops in the instantaneous flush water flow volume when flush water flows into the cylindrical body 220 can be prevented, and a flush toilet 200 capable of efficiently supplying flush water to the toilet main body 202 can be provided.

Hence a flush toilet 200 can be provided with which the toilet main body 202 flushing performance can be improved and flush water can be conserved.

Moreover, using a discharge valve apparatus 208 according to a second embodiment of the invention, the cylindrical body 220 can be selected according to flush water tank 206 specifications and can be easily attached from above to the discharge valve apparatus 208 main body portion 218, therefore a specified water level inside the flush water tank 206 can be easily set, and ease of assembly between the main body portion 218 and the cylindrical body 220 can be improved.

In addition, because of the respective formation of the first tab portion 260 and second tab portion 270 which respectively serve as the infiltration preventing portions on the first attachment surface 258 and the second attachment surface 268 of the cylindrical body 220 attached to the main body portion 218, infiltration of flush water in the flush water tank 206 from the first attachment surface 258 and the second attachment surface 268 on the cylindrical body 220 into the cylindrical body 220 is prevented, and flush water can be made to flow into the cylindrical body 220 from only the top of the cylindrical body 220, therefore with respect to flush water supplied to the toilet main body 202 from the discharge port portion 214 discharge port 214*a*, flush water infiltrating into the cylindrical body 220 from the attachment portion of the cylindrical body 220 can be prevented from contributing as wasted water, and variability in the flow volume supplied to the toilet main body can also be prevented.

Also, even at times such as after completion of a flush, when the water level inside the flush water tank 206 outside the cylindrical body 220 is below the top end of the cylindrical body 220, and the discharge port portion 214 discharge port 214*a* connected to the flush water tank 206 discharge port 206*b* is released by the opening of the main body portion 218 valve body 238 so that flush water inside the cylindrical body 220 drops, and a pressure difference is created between the inside and outside of the cylindrical body 220, flush water outside the cylindrical body 220 can be prevented by the first tab portion 260 and second tab portion 270 serving as infiltration prevention portions from infiltrating into the cylindrical body 220 from the cylindrical body 220 first attachment surface 258 and second attachment surface 268, respectively, thereby preventing the occurrence of water waste.

As a result of the above, ease of assembly between the main body portion 218 and the cylindrical body 220 can be improved, and variability in flush water amounts and the occurrence of water waste can be prevented to achieve water conservation.

Using a discharge valve apparatus 208 according to the present embodiment, the first tab portion 260 distorts with the cylindrical body 220 bottom side opening portion 246 attached to the attachment portion of the discharge port portion main body 222 on the discharge port portion 214, and the gap between the first attachment surface 258 and the outer perimeter surface of the attachment portion of the discharge port portion main body 222 of the discharge port portion 214 is sealed, therefore flush water in the flush water tank 206 is prevented from infiltrating in from the attachment portion of the cylindrical body 220, so that with respect to flush water supplied from the discharge port portion 214 discharge port 214*a* to the toilet main body 202, flush water infiltrating into the cylindrical body 220 from the gap between the cylindrical body 220 first attachment surface 258 and the outer perimeter surface of the attachment portion of the discharge port portion main body 222 of the discharge port portion 214 can be prevented from contributing as wasted water, and variability in the flush water amount supplied to the toilet main body 202 can be prevented.

As a result of the above, ease of assembly between the main body portion 218 and the cylindrical body 220 can be improved, and variability in flush water amounts and the occurrence of water waste can be prevented, thereby achieving water conservation.

Using a discharge valve apparatus 208 according to a present embodiment, when the inside perimeter side of the cylindrical body 220 bottom side opening portion 246 is attached to the outside perimeter surface of the attachment portion of the discharge port portion main body 222 on the discharge port portion 214, the top ends of these projections 262 and the bottom end of the projecting portion 234 are reliably locked immediately after the multiple projections 262 formed on the first attachment surface 258 on the inside perimeter side of the cylindrical body 220 bottom side opening portion 246 pass over the projecting portion 234 on the outside perimeter surface of the attachment portion of the discharge port portion main body 222 on the discharge port portion 214, therefore the cylindrical body 220 can be strongly affixed to the main body portion 218.

Also, even if a force acts to cause the cylindrical body 220 to float due to the flush water pressure inside the flush water tank 206, the reliable locking between the multiple projections 262 on the first attachment surface 258 on the inside perimeter side of the lower opening portion 246 of the cylindrical body 220 and the projecting portion 234 on the attachment portion of the discharge port portion main body 222 on the discharge port portion 214 stops the cylindrical body 220 from pulling out of the main body portion 218, so that the cylindrical body 220 can be held stably to the main body portion 218.

As a result of the above, ease of assembly between the main body portion 218 and the cylindrical body 220 can be improved, and variability in flush water amounts and the occurrence of water waste can be prevented, thereby achieving water conservation.

Using a discharge valve apparatus 208 according to the present embodiment, the second tab portion 270 distorts with the cylindrical body 220 attached to the discharge port portion 214, and the gap between the second attachment surface 268 and the discharge port portion 214 overflow pipe connecting portion 228 rib 228*a* is sealed, therefore infiltration of flush water from the gap between the second attachment surface 268 and the discharge port portion 214 overflow pipe connecting portion 228 rib 228*a* into the cylindrical body 220 can be prevented, so that for flush water supplied from the discharge port 214*a* in the discharge port portion 214 to the toilet main body 202, flush water infiltrating from the gap between the second attachment surface 268 and the discharge port portion 214 overflow pipe connecting portion 228 rib 228*a* surface into the cylindrical body 220 can be prevented from contributing as water waste, and variability in the amount of flush water supplied to the toilet main body 202 can be prevented.

As a result of the above, ease of assembly between the main body portion 218 and the cylindrical body 220 can be improved, and variability in flush water amounts and the occurrence of water waste can be prevented, thereby achieving water conservation.

In addition, using a flush water tank apparatus 204 including a discharge valve apparatus 208 according to the present embodiment, a flush water tank apparatus 204 can be provided in which a specified water level (stopped water level (or dead water level) DWL) in the flush water tank 206 can be easily set merely by retrofitting the cylindrical body 220 of a discharge valve apparatus 208, selected according to the specifications of the flush water tank 206, to the main body portion 218 of the discharge valve apparatus 208, and the amount of flush water supplied from the flush water tank 206 to the toilet main body 202 can be easily adjusted.

Also, flush water infiltrating into the cylindrical body 220 interior from the attachment portion between the main body portion 218 and the cylindrical body 220 of the discharge valve apparatus 208 can be prevented from contributing as water waste, and variability in the amount of flush water supplied to the toilet main body can be prevented.

As a result of the above, ease of assembly between the main body portion 218 and the cylindrical body 220 can be improved, and variability in flush water amounts and the occurrence of water waste can be prevented to achieve water conservation.

Figure 29:
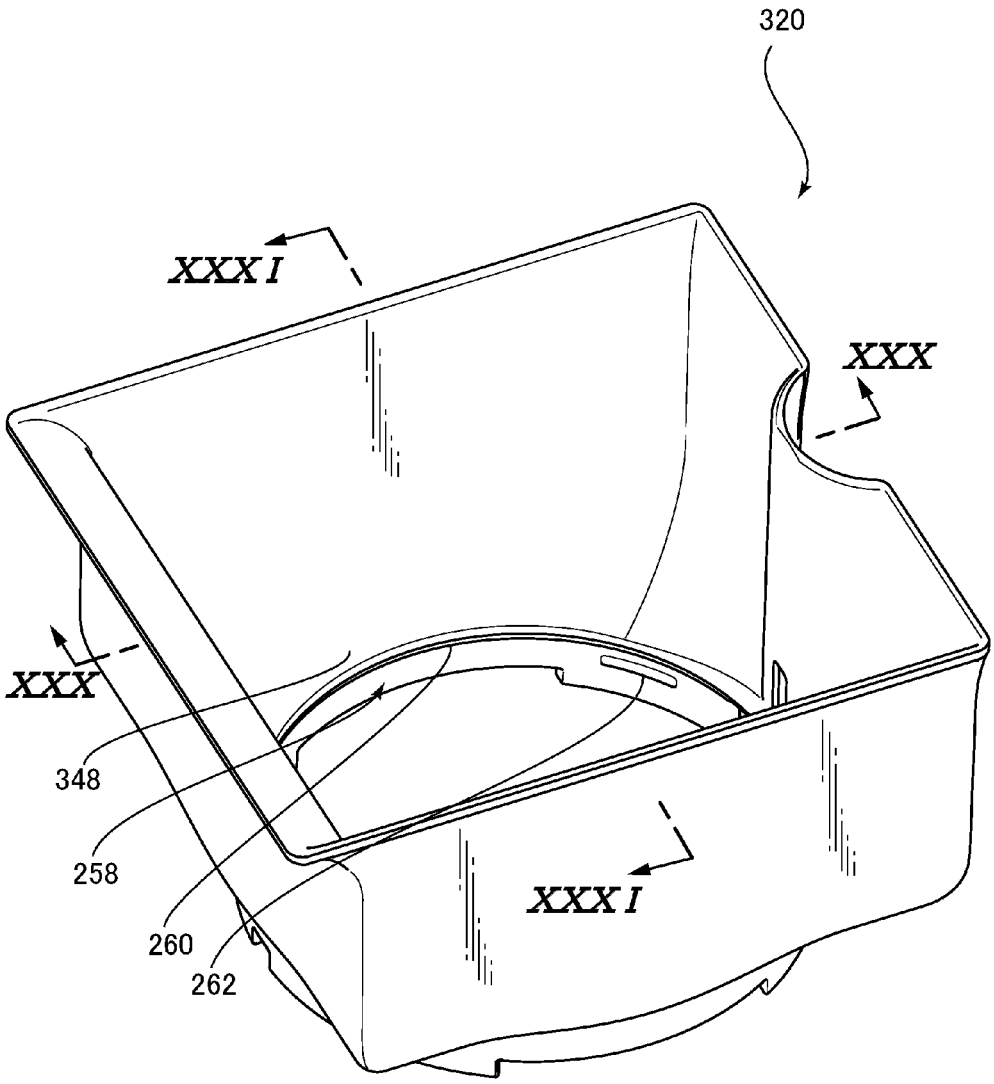
FIG. 29 is a perspective view seen from diagonally above of a cylindrical body in a discharge valve apparatus according to a third embodiment of the invention.
Figure 30:
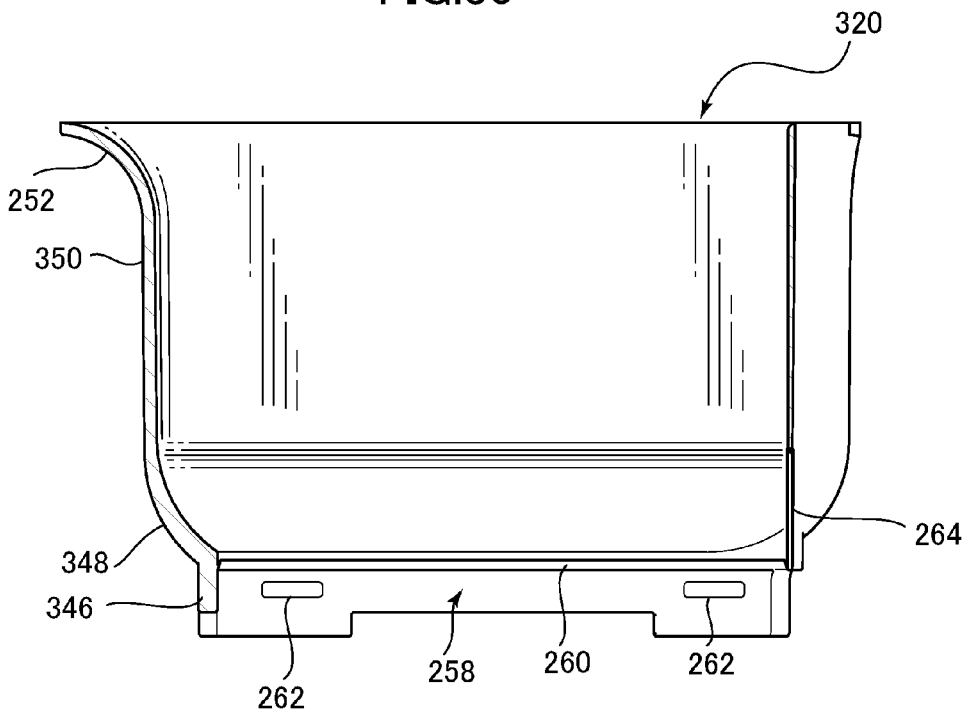
FIG. 30 is a cross section along line XXX-XXX in FIG. 29.
Figure 31:
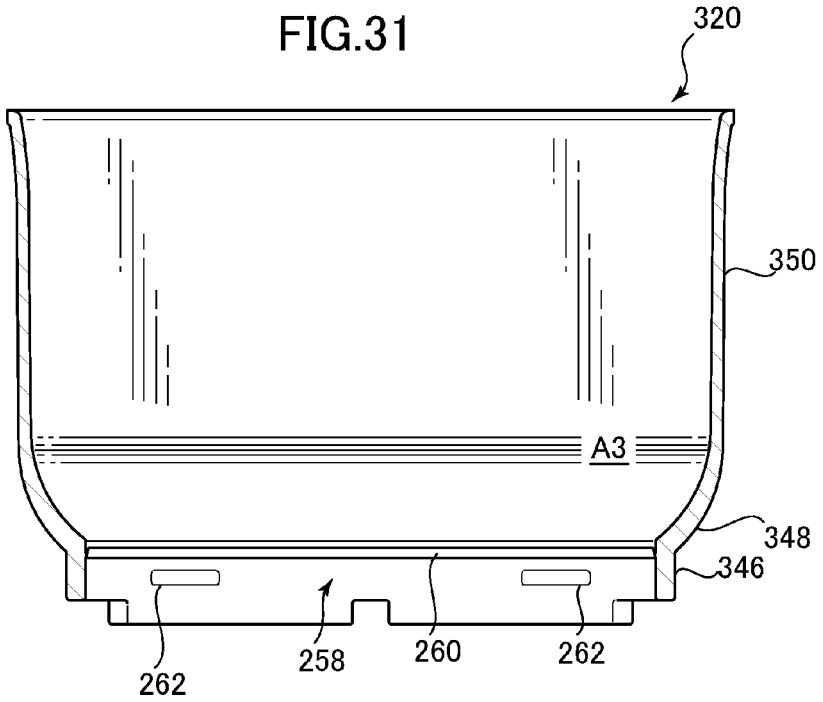
FIG. 31 is a cross section along line XXXI-XXXI in FIG. 29.

Next, referring to FIGS. 29 through 31, we explain the cylindrical body in a discharge valve apparatus according to a third embodiment of the invention.

FIG. 29 is a perspective view seen from diagonally above of a cylindrical body in a discharge valve apparatus according to a third embodiment of the invention; FIG. 30 is a cross section along line XXX-XXX in FIG. 29.

Note that for the cylindrical body in a discharge valve apparatus according to the third embodiment of the invention shown in FIGS. 29 through 31, the same reference numerals are assigned to those parts which are the same as the cylindrical body 220 in the discharge valve apparatus 208 according to the second embodiment of the invention, and an explanation thereof is omitted; we explain only the parts which differ between the discharge valve apparatus 208 and the cylindrical body 220 according to the second embodiment of the invention.

As shown in FIGS. 29 through 31, the cylindrical body 320 of a discharge valve apparatus according to a third embodiment of the invention differs from the bottom surface portion 248 of the cylindrical body 220 in the discharge valve apparatus 208 according to a second embodiment of the invention in that the bottom surface portion 348 of the cylindrical body 320 is formed in a shape curving from the bottom end of the side wall portion 350 to the top end of the lower opening portion 346 so that the flow path surface area of the lower region A3 in the cylindrical body 320 diminishes in the downward direction.

Using a cylindrical body 320 in a discharge valve apparatus according to a third embodiment of the invention, this cylindrical body 320 bottom surface portion 348 is formed in a shape curving from the bottom end of the side wall portion 350 to the top end of the lower opening portion 346 so that the flow path surface area of the lower region A3 in the cylindrical body 320 diminishes in the downward direction, therefore the volume of the cylindrical body 320 itself can be reduced compared to the case where the flat-formed cylindrical body 320 is used for the bottom surface portion 348.

Hence the amount of flush water supplied from the interior of the cylindrical body 320 through the discharge port 214*a* in the discharge port portion 214 to the toilet main body 202 can be reduced, and flush water used for toilet flushing can be conserved.

Also, as with the cylindrical body 220 in the discharge valve apparatus 208 according to a second embodiment of the invention, the assembly of the first tab portion 260 and second tab portion 270 serving as the cylindrical body 320 infiltration prevention portion, and the assembly of the cylindrical body 320 projections 262 and the discharge port portion main body 222 projecting portion 234, enable improved ease of assembly between the main body portion 218 and the cylindrical body 220, in addition to which the occurrence of variability in flush water amounts and water waste can be suppressed, the amount of flush water supplied to the toilet main body 202 from the interior of the cylindrical body 320 selected according to flush water tank 206 specifications through the discharge port 214*a* of the discharge port portion 214 can be effectively reduced, and conservation of flush water used for toilet flushing can be achieved.

Note that in the above-described cylindrical body 220 of a discharge valve apparatus 208 according to a second embodiment of the invention, and in the cylindrical body 320 of a discharge valve apparatus according to a third embodiment of the invention, we explained forms in which the lower part of the discharge port portion 214 of the main body portion 218 of the discharge valve apparatus 208 is inserted and affixed to the discharge port 206*b* on the flush water tank 206, and the cylindrical body 220 or 320 selected according to the flush water tank 206 specifications is attached from above to the discharge port portion 214 of the main body portion 218 of the discharge valve apparatus 208, but the invention may also be applied to other forms.

I.e., as another form it is also acceptable with respect to the cylindrical body 220 or 320 to first attach the attachment portion on the cylindrical body 220 or 320 from below to a predetermined attachment portion of the discharge port portion 214 on the main body portion 218 of the discharge valve apparatus 208 prior to inserting and affixing the lower part of the discharge port portion 214 on the main body portion 218 of the discharge valve apparatus 208 to the discharge port 206*b* on the flush water tank 206, then insert the lower part of the main body portion 218 on the discharge valve apparatus 208 into the discharge port 206*b* of the flush water tank 206 with this cylindrical body 220 or 320 in an attached state, thereby affixing the cylindrical body 220 or 320 of the main body portion 218 of the discharge valve apparatus 208 to the flush water tank 206.

The following Modes 1 through 14 may also be listed as still other preferred modes of the invention.

(Mode 1)

A discharge valve apparatus on a flush water tank for storing flush water for flushing a toilet main body, comprising:

a main body portion including a discharge port portion attached to a discharge port formed on the flush water tank, and a valve body for opening and closing this discharge port portion; and a cylindrical body attached to the main body portion;

wherein this cylindrical body includes a lower opening portion attached to the discharge port portion of the main body portion, a bottom surface portion projecting on the outer perimeter side from this lower opening portion, a side wall portion extending upward from this bottom surface portion and surrounding the main body portion, and an upper opening portion contiguous with the top end of this side wall portion; and wherein a curved surface is formed on this upper opening portion of the cylindrical body so as to separate from the bottom end toward the top end thereof.

In the Mode 1 thus constituted, a curved surface is formed on this upper opening portion of the cylindrical body so as to separate from the bottom end toward the top end thereof, therefore a sudden change from the relatively large flow path cross sectional area inside the flush water tank to the flow path cross sectional area inside the cylindrical body is prevented when the discharge port on the flush water tank is released by the opening of the valve body on the main body portion of the discharge valve apparatus and the water level inside the flush water tank drops. Therefore since pressure losses near the upper opening portion of the cylindrical body are prevented, flush water flowing into the upper opening portion of the cylindrical body can flow smoothly into the cylindrical body along the curved surface of the cylindrical body upper opening portion. Also, when flush water flows into the cylindrical body, instantaneous drops in the flush water flow volume can be effectively prevented, therefore flush water can be efficiently supplied to the toilet main body. As a result of these things, flushing performance of the toilet main body can be improved, and flush water conservation can be achieved.

Mode 2

The discharge valve apparatus according to Mode 1, wherein the cylindrical body is formed so that the flow path cross sectional area formed in the region on the inside thereof and outside the main body portion diminishes in the downward direction.

According to the Mode 2 thus constituted, the cylindrical body is formed so that the flow path cross sectional area formed in the region on the inside thereof and outside the main body portion diminishes in the downward direction, therefore when flush water in the flush water tank passes through the flow path in the region on the inside of the cylindrical body and outside the main body portion after flowing from the upper opening portion of the cylindrical body into the cylindrical body, it becomes more difficult for the flow of flush water to peel away inside the flow path, so turbulence can be prevented. Hence drops in the instantaneous flush water flow volume can be prevented, and flush water can be efficiently supplied to the toilet main body, so the toilet main body flushing performance can be improved and flush water can be conserved.

Mode 3

The discharge valve apparatus according to the Mode 1, wherein the main body portion further includes a communication port portion forming a communication port for causing a first region inside the cylindrical body and outside the main body portion to communicate with a second region inside the discharge port part, and the flow path from the first region through the communication port, and from the second region up to the flush water tank discharge port, and the port is formed so that its flow path cross sectional area becomes increasingly small in the downstream direction.

According to the Mode 3 thus constituted, the flow path from the first region through the communication port, and from the second region up to the flush water tank discharge port, is formed so that its flow path cross sectional area becomes increasingly small in the downstream direction, therefore when flush water inside the flush water tank passes through the flow path from the first region through the communication port, and from the second region up to the flush water tank discharge port after flowing into the cylindrical body from the upper opening portion of the cylindrical body, turbulence in the flow of flush water inside the flow path can be prevented. Therefore drops in the instantaneous flow volume of flush water within these flow paths can be prevented, and flush water can be efficiently supplied to the toilet main body, so the toilet main body flushing performance can be improved and flush water can be conserved.

Mode 4

The discharge valve apparatus according to the Mode 1, wherein the bottom surface portion of the cylindrical body is formed in a curved shape from the bottom end of the side wall portion toward the top end of the bottom opening portion so that the flow path cross sectional area in the lower region inside the cylindrical body diminishes toward the downward direction.

According to the Mode 4 thus constituted, the bottom surface portion of the cylindrical body is formed in a curved shape from the bottom end of the side wall portion toward the top end of the bottom opening portion so that the flow path cross sectional area in the lower region inside the cylindrical body diminishes toward the downward direction, therefore compared to the case of a cylindrical body in which the bottom surface portion is formed to be flat, the volume of the cylindrical body itself can be reduced. Hence the amount of flush water supplied from the interior of the cylindrical body through the discharge port portion to the toilet main body can be reduced, and flush water used for toilet flushing can be conserved.

Mode 5

The discharge valve apparatus according to the Mode 1, wherein the cylindrical body can be attached from above to the main body portion after the main body portion is pre-affixed to the flush water tank.

According to the Mode 5 thus constituted, the cylindrical body can be easily attached from above to the main body portion after the main body portion is pre-affixed to the flush water tank, so that flushing performance of the toilet main body can be improved, and flush water can be conserved.

Mode 6

A flush water tank apparatus including the flush water discharge valve apparatus according to the Mode 1.

According to the Mode 6 thus constituted, a flush water tank apparatus can be provided with which a drop in the instantons flow volume of flush water when it flows into the cylindrical body can be prevented, and flush water can be efficiently supplied to the toilet main body. Therefore a flush water tank apparatus can be provided with which toilet main body flushing performance can be improved and flush water can be conserved.

Mode 7

A flush toilet including the flush water tank apparatus according to the Mode 6.

In the Mode 7 thus constituted, a flush toilet can be provided with which a drop in the instantons flow volume of flush water when it flows into the cylindrical body can be prevented, and flush water can be efficiently supplied to the toilet main body. Hence a flush toilet can be provided with which the toilet main body flushing performance can be improved and flush water can be conserved.

Mode 8

A discharge valve apparatus on a flush water tank for storing flush water for flushing a toilet main body, comprising:

a main body portion including a discharge port portion attached to a discharge port formed on the flush water tank, and a valve body for opening and closing this discharge port portion; and a cylindrical body attached to this main body portion and freely selectable according to the specifications of the flush water tank;

wherein the cylindrical body includes a lower opening portion attached to the discharge port portion of the main body portion, and a side wall portion surrounding this main body portion after projecting from this lower opening portion on the outer perimeter side; and wherein a water infiltration prevention portion for preventing the infiltration of flush water outside the cylindrical body from the attachment portion into the cylindrical body is formed on the cylindrical body attachment portion attached to the main body portion.

According to the Mode 8 thus constituted, attachment to the main body portion of a cylindrical body freely selected according to the specifications of the flush water tank enables easy setting of a specified water level inside the flush water tank, and improved ease of assembly between the main body portion and the cylindrical body. In other words, a water infiltration prevention portion can be formed on the attachment portion of the cylindrical body attached to the main body portion, therefore infiltration by flush water in the flush water tank from the cylindrical body attachment portion into the cylindrical body can be prevented, and flush water can be made to flow into the cylindrical body from above the cylindrical body only, hence relative to flush water supplied from the discharge port portion to the toilet main body, flush water infiltrating from the cylindrical body attachment portion into the cylindrical body can be prevented from contributing to water waste, and variability in the amount of flush water supplied to the flush toilet can also be prevented. Also, even at times such as after completion of a flush, when the water level inside the flush water tank outside the cylindrical body is below the top end of the cylindrical body, and the discharge port on the flush water tank is released by the opening of the main body portion valve body so that flush water inside the cylindrical body drops, creating a pressure difference between the inside and outside of the cylindrical body, flush water outside the cylindrical body can be prevented by the infiltration prevention portion from infiltrating into the cylindrical body from the cylindrical body attachment portion, hence the occurrence of water waste can be prevented. As a result of the above, ease of assembly between the main body portion and the cylindrical body can be improved, and variability in flush water amounts and the occurrence of water waste can be prevented to achieve water conservation.

Mode 9

The discharge valve apparatus according to the Mode 8, wherein the cylindrical body attachment portion forms a first attachment surface opposing the outer perimeter surface of the discharge port portion on the inside perimeter portion of the lower opening portion, and an outwardly-projecting projecting portion is formed on the outer perimeter surface of the discharge port portion, multiple projections projecting inward are formed at intervals in the perimeter direction on the first attachment surface, and these projections are lockable to the projecting portions with the cylindrical body attached to the discharge port portion.

According to the Mode 9 thus constituted, when the inside perimeter side of the lower opening portion of the cylindrical body is attached to the discharge port portion, the multiple projections formed on the first attachment surface on the inside perimeter side of the lower opening portion of the cylindrical body are reliably locked to the projection portion after they pass over the outer perimeter surface projection portion on the discharge port portion, so the cylindrical body can be strongly affixed to the main body portion. Even if a force acts to cause the cylindrical body to float due to the flush water pressure inside the flush water tank, reliable locking between the multiple projections on the first attachment surface on the inside perimeter side of the lower opening portion of the cylindrical body and the projecting portion on the outside perimeter surface of the discharge port portion stops the cylindrical body from pulling out of the main body portion, so that the cylindrical body can be held stably to the main body portion. As a result of these things, ease of assembly between the main body portion and the cylindrical body can be improved, and variability in flush water amounts and the occurrence of water waste can be prevented to achieve water conservation.

Mode 10

The discharge valve apparatus according to the Mode 9, in which the infiltration prevention portion is a first tab portion formed integrally with the first attachment surface, and this first tab portion deforms with the cylindrical body attached to the discharge port portion, sealing the gap between the first attachment surface and the outer perimeter surface of the discharge port portion.

According to the Mode 10 thus constituted, the first tab portion, which is the infiltration prevention portion, deforms with the cylindrical body attached to the discharge port portion and seals the gap between the first attachment surface and the outer perimeter surface of the discharge port portion, therefore infiltration of flush water in the flush water tank into the cylindrical body is prevented, so that flush water infiltrating from the gap between the first attachment surface and the discharge port portion outer perimeter surface into the interior of the cylindrical body can be prevented relative to flush water supplied from the discharge port portion to the toilet main body, and variability in the amount of flush water supplied to the toilet main body can be prevented. As a result of the above, ease of assembly between the main body portion and the cylindrical body can be improved, and variability in flush water amounts and the occurrence of water waste can be prevented to achieve water conservation.

Mode 11

The discharge valve apparatus according to the Mode 9, further having an overflow pipe connected to a connecting portion on a discharge port portion, and discharging flush water through the connecting portion to the discharge port portion when flush water in the flush water tank exceeds a specified water level, whereby the cylindrical body attachment portion, with the cylindrical body attached to the discharge port portion, furthermore forms a second attachment surface facing the discharge port portion connecting portion on the side wall portion of the cylindrical body to which the discharge port portion attachment portion is attached, and the infiltration prevention portion is a second tab portion formed integrally on the second attachment surface, and this second tab portion deforms with the cylindrical body attached to the discharge port portion, so that the gap between the second attachment surface and the discharge port portion connecting portion can be sealed.

According to the Mode 11 thus constituted, the second tab portion serving as infiltration prevention portion deforms with the cylindrical body attached to the discharge port portion and seals the second attachment surface and the discharge port portion connecting portion, therefore since flush water is prevented from infiltrating from the gap between the second attachment surface and the discharge port portion connecting portion into the cylindrical body, flush water infiltrating into the cylindrical body from the gap between the second attachment surface and the discharge port portion connecting portion can be prevented from contributing to water waste with respect to flush water supplied from the discharge port portion to the toilet main body, and variability in the amount of flush water supplied to the toilet main body can be prevented. As a result of the above, ease of assembly between the main body portion and the cylindrical body can be improved, and variability in flush water amounts and the occurrence of water waste can be prevented to achieve water conservation.

Mode 12

The discharge valve apparatus according to the Mode 8, wherein the cylindrical body can be attached from above to the main body portion after the main body portion is pre-affixed to the flush water tank discharge port.

According to the Mode 12 thus constituted, a specified water level inside the flush water tank can be even more easily set by a simple attaching operation in which a cylindrical body freely selected in accordance with the flush water tank specifications is attached from above to the main body portion after the main body portion is affixed to a discharge port on the flush water tank.

Mode 13

A flush water tank apparatus including the flush water discharge valve apparatus according to the Mode 8.

In the Mode 13 thus constituted, a flush toilet can be provided in which a specified water level inside the flush water tank can be easily set simply by attaching a cylindrical body in a discharge valve apparatus, selected according to flush water tank specifications, to the discharge valve apparatus, and the amount of flush water supplied from the flush water tank to the toilet main body can be easily adjusted. Also, flush water infiltrating into the cylindrical body interior from the attachment portion of the cylindrical body in the discharge valve apparatus can be prevented from contributing as water waste, and variability in the amount of flush water supplied to the toilet main body can be prevented. As a result of the above, ease of assembly between the main body portion and the cylindrical body can be improved, and variability in flush water amounts and the occurrence of water waste can be prevented to achieve water conservation.

Mode 14

A flush toilet including the flush water tank apparatus according to the Mode 13.

In the Mode 14 thus constituted, a flush toilet can be provided in which a specified water level inside the flush water tank can be easily set simply by attaching a cylindrical body in a discharge valve apparatus, selected according to flush water tank specifications, to the discharge valve apparatus, and the amount of flush water supplied from the flush water tank to the toilet main body can be easily adjusted. Also, flush water infiltrating into the cylindrical body interior from the attachment portion of the cylindrical body in the discharge valve apparatus can be prevented from contributing as water waste, and variability in the amount of flush water supplied to the toilet main body can be prevented.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A discharge valve apparatus attached to a discharge port on a flush water tank comprising:

a discharge main body disposed above the flush water tank discharge port, the discharge main body having a valve body portion disposed inside a casing;

wherein the discharge main body includes an attachment portion, the attachment portion allowing an operating wire extending from a wire pull-up operating apparatus to detachably attach to the valve body portion, and wherein the attachment portion is configured to indirectly and detachably attach an outer perimeter surface of a part of the operating wire to the casing so that the operating wire slides relative to the casing.

2. The discharge valve apparatus according to claim 1, wherein the attachment portion includes a valve body-side attachment hole portion disposed at a top portion of a valve body portion shaft the valve body-side attachment hole portion having an attachment hole; and a casing-side attachment hole portion having a casing attachment hole disposed on the upper portion of the casing.

3. The discharge valve apparatus according to claim 2, wherein the casing attachment hole on the casing-side attachment hole portion of the attachment portion and the valve body-side attachment hole of the valve body-side attachment hole portion disposed on the upper portion of the valve body portion shaft are disposed on an essentially straight line when the valve body portion is raised at a predetermined position.

4. The discharge valve apparatus according to claim 2, wherein the casing-side attachment hole portion on the attachment portion includes a casing-side slit portion extending upward from the valve body-side attachment hole in the valve body-side attachment hole portion, and extending up to a position at which the inner operating wire is attached; and the valve body-side attachment hole portion of the attachment portion includes a valve body-side slit extending upward from the valve body attachment hole in the valve body-side attachment hole portion, and extending up to a position at which the inner operating wire is attached.

5. The discharge valve apparatus according to claim 1, wherein the attachment portion includes a tube attachment portion capable of detachably attaching a tube covering the operating wire to the casing.

6. The discharge valve apparatus according to claim 5, wherein the tube attachment portion of the attachment portion includes a projection for preventing the attached tube from detaching from the casing.

7. The discharge valve apparatus according to claim 5, wherein the tube attachment portion of the attachment portion includes a tube pull-out stop member for preventing the attached tube from detaching from the casing.

8. The discharge valve apparatus according to claim 5, wherein the tube includes a flange portion whose outside diameter is at least in part larger than the outside diameter of the tube at the end portion of the tube; and wherein the tube attachment portion of the attachment portion includes a narrow width-shaped narrow width channel portion extending inward from the side surface of the casing peak portion wherein the narrow width-shaped narrow width channel portion has a top portion that has an opening at the casing peak surface, and extends inward from the side surface of the casing peak portion such that the narrow width-shaped narrow width channel portion holds the tube part extending upward from the flange portion; and a wide width channel portion connected to the bottom portion of the narrow width channel portion, wherein the wide width channel portion extends inward from the side surface of the casing peak portion, and has a width that is wider than a width of the narrow width channel portion such that the wide width channel portion holds the flange portion, the flange portion being inserted into the wide width channel portion from the side of the casing.

9. A flush water tank apparatus comprising the flush water discharge valve apparatus according to claim 1.

10. A flush toilet comprising the flush water tank apparatus according to claim 9.

* * * * *